US005771008A

United States Patent [19]

Hayashi et al.

[11] Patent Number: 5,771,008

[45] Date of Patent: Jun. 23, 1998

[54] MOBILE UNIT COMMUNICATION CONTROL METHOD

[75] Inventors: Hironao Hayashi, Motosu-gun; Kan Watanabe, Nishikamo-gun, both of Japan

[73] Assignee: Toyota Jidosha Kabushiki Kaisha, Toyota, Japan

[21] Appl. No.: 726,365

[22] Filed: Oct. 4, 1996

[51] Int. Cl.[6] ..... G08G 1/09

[52] U.S. Cl. ..... 340/905; 340/901; 340/991; 340/928; 235/384

[58] Field of Search ..... 340/901, 902, 340/904, 905, 941, 988, 991, 992, 993, 994, 928; 235/384; 455/54.1

[56] References Cited

U.S. PATENT DOCUMENTS

| | | | |
|---|---|---|---|
| 4,408,179 | 10/1983 | Matsumura | 340/905 |
| 5,089,815 | 2/1992 | Potter et al. | 340/905 |
| 5,406,275 | 4/1995 | Hassett et al. | 340/933 |
| 5,581,249 | 12/1996 | Yoshida | 340/928 |

FOREIGN PATENT DOCUMENTS

| | | |
|---|---|---|
| 4-315284 | 11/1992 | Japan . |
| 5-12290 | 1/1993 | Japan . |
| 6-131590 | 5/1994 | Japan . |
| 6-181449 | 6/1994 | Japan . |
| 6-258425 | 9/1994 | Japan . |

*Primary Examiner*—Jeffery Hofsass
*Assistant Examiner*—Ashok Mannava
*Attorney, Agent, or Firm*—Cushman Darby Cushman IP Group of Pillsbury Madison & Sutro LLP

[57] ABSTRACT

A mobile unit communication control method is for exchanging information accurately between a plurality of responders and a questioner in a communication area without information drop-off. A ground unit constituting the questioner transmits an inquiry signal. A vehicle-mounted unit constituting the responder stores and returns the current time the vehicle-mounted unit first received the inquiry signal as a starting time. The ground unit selects a vehicle-mounted unit with the earliest starting time as an object of communication among a plurality of the vehicle-mounted units. A vehicle-mounted unit expected to pass the communication area at the earliest time is selected, and the ground unit transmits a response signal for handshaking with the particular vehicle-mounted unit, to which the vehicle-mounted unit replies. With the establishment of the handshake, data are exchanged between the ground unit and the vehicle-mounted unit.

20 Claims, 33 Drawing Sheets

MOBILE UNIT COMMUNICATION CONTROL METHOD

BACKGROUND OF THE INVENTION

1. Field of the Invention

The present invention relates to a mobile unit communication control method, and in particular to a mobile unit communication control method for exchanging information by radio wave communication between a vehicle and a ground unit for managing information on the vehicle.

2. Description of the Related Art

Charges are collected at a fee-charging facility. A vehicle running on a toll road, for example, is charged according to the vehicle type or distance covered on the toll road. As a method for automatically collecting the charges at a fee-charging facility, a mobile unit communication control method in which the charge is collected at an inlet or an outlet gate of a toll road by radio wave communication is well known. A system used for the mobile unit communication control method comprises a communication unit (hereinafter referred to as "the ground unit") as a questioner installed on the road side with an antenna having a communication area set therefor, and another communication unit (hereinafter referred to as "the vehicle-mounted unit") as a responder mounted on a vehicle and having an antenna. In this system, the ground unit makes an inquiry by radio wave to a vehicle-mounted unit, while the vehicle-mounted unit responds to the information inquired within the communication area. In this way, information is exchanged between the vehicle-mounted unit and the ground unit by one-to-one communication.

The above-mentioned communication area is set to a predetermined size taking into consideration the location of the antenna and the normal running speed of the vehicles. A plurality of vehicles, however, may advance into the communication area. In the information exchange based on the one-to-one radio communication like the mobile unit communication control method described above, the radio wave of the vehicle with which information is being exchanged is interfered by the radio waves of other vehicles advanced in the communication area, thereby making normal information exchange impossible. Normal information exchange with such other vehicles also becomes impossible as it is interfered by the radio wave of the vehicle participating in the system. As a result, when a plurality of vehicles advance into the communication area, normal information exchange is impossible between any of the vehicles, and in particular the communication area and the ground unit.

In order to solve this problem, JP-A-6-181449 discloses a technique for providing a mobile unit identification system corresponding to an apparatus based on the mobile unit communication control method wherein no radio interference is caused even when a plurality of responders are present in a communication area by employing a time-division multiplex connection scheme between a questioner and a plurality of responders. According to this technique, an inquiry from the questioner fixedly installed on the road side to the responders is transmitted as data configured of a plurality of time-divided channels per cycle. This data is assigned one of a plurality of channels for storing information which is desired to be transmitted from the questioner to all the responders. Each of the other channels, on the other hand, is assigned exclusively to each responder for storing information to be transmitted to the particular responder. The responder on the vehicle receives the data from the questioner, selects a vacant channel from the received data, and stores and returns the information unique to the responder in the selected vacant channel. In this technique, each responder monitors the vacancy or occupancy of the selected channel and the adaptability of the information in the channel, thereby making possible one-to-one communication with the questioner. Each questioner monitors the vacancy or occupancy of each of the sent-back channels and the adaptability of the information in the channel, thereby making possible one-to-one communication with each responder. Even when a plurality of responders exist in the communication area, therefore, information can be exchanged without interference.

In the conventional mobile unit communication control method, however, the inquiry is configured by a plurality of channels preset as data to be transmitted, and a plurality of responders are handled equally. Therefore, the total communication time of a plurality of channels, i.e., the communication time being twice as long as the number of channels, is always required for vehicles. As a result, a vehicle not having sufficient time to pass through the communication area, such as a vehicle passing an end of the communication area or a vehicle having only a small part of the communication area remaining to cover, may have to terminate the communication entering the communication wait mode in spite of the communication being required to continue between the responder and the questioner. In this way, when the vehicle passes through the communication area before complete communication, accurate information exchange is impossible.

An example of a vehicle passing an end of the communication area is a vehicle running at high speed in an interchange or along an intermediate route of a toll road. The time allowed for communication with such a vehicle is further reduced, often making impossible positive information exchange.

SUMMARY OF THE INVENTION

The object of the present invention is to provide a mobile unit communication control method in which information can be positively exchanged between each of a plurality of responders and a single questioner in a communication area.

In order to achieve the above-mentioned object, according to the present invention, there is provided a mobile unit communication control method for exchanging information by radio communication between a responder installed on each of a plurality of mobile units moving on the ground surface and a questioner installed on the ground and having a communication area for radio communication with the responder. The method comprises the steps of causing each of the responders to transmit status information representing the status thereof in the communication area, and causing the questioner to estimate the time each responder is expected to pass the communication area on the basis of the status information transmitted from the responder and determine a responder estimated to pass the communication area at the earliest time as an object of communication.

According to a first aspect of the invention, each responder is adapted to determine the status information representing the status thereof in a communication area and can transmit the status information thus determined. In this case, the status information may be the advance time information representing the time when the responder advances into the communication area. Also, the distance coverage information representing the distance covered after the responder advances into the communication area may be used as the status information.

According to a second aspect of the invention, each responder returns at least the information received from the questioner as it is. The questioner transmits the communication time information representing the time of communication from the particular questioner as the status information, and the responder that has returned the oldest communication time information as determined on the basis of the communication time information contained in the information returned from each of the responders is estimated as a responder expected to pass the communication area at the earliest time and determined as an object of communication. In this case, the transmission number updated for each transmission from the questioner can be used as the communication time information. Also, the time of transmission from the questioner may be used as the communication time information.

In the first aspect of the invention, each responder determines the status information representing the status thereof in the communication area and transmits the status information thus determined. The status information referred to herein is defined as information corresponding to the relative positions of a plurality of responders in the communication area, the time the responder is expected to pass the communication area and the order in which a plurality of responders is expected to pass the communication area. The status information may be the advance time information representing the time each responder advances into the communication area. If each responder transmits the advance time information, the questioner can determine the chronological order of a plurality of responders and can thus specify the order of the responders passing the communication area. Another alternative status information may be coverage information representing the distance covered by each responder after having advanced into the communication area. If each responder transmits the coverage information, the questioner can determine the remaining distance each of the responders has to cover to pass through the communication area. In this way, once the order of the responders passing the communication area or the remaining distance to cover to pass through the communication area can be determined for each responder, the time each responder is expected to pass the communication area can be estimated. The questioner, therefore, estimates the time each responder is expected to pass the communication area on the basis of the status information transmitted from the responder, and determines a responder with the earliest estimated time as an object of communication. As a result, a responder expected to pass the communication area at the earliest time with which communication is required in priority can be matched with the questioner. By giving priority to the communication with the responder expected to pass the communication area at the earliest time, the communication can be established more securely between the questioner and a responder having only a small time remaining before passing through the communication area.

Each of a plurality of the responders can also communicate with the other vehicles to detect the order of the particular responder with respect to the other responders and can use the order of the responders thus determined as the status information. Once the order of responders is determined by communication among a plurality of responders in this way, the vehicles should pass the communication area according to the particular order. The questioner thus can estimate the order in which the responders pass through the communication area on the basis of the order thus determined, and can determine a responder expected to pass the communication area at the earliest time as an object of communication with top priority.

As still another alternative, the electric field intensity around each of a plurality of responders is detected, and when a predetermined electric field intensity generated by the radio wave from the questioner is exceeded, the advance into the communication area is detected. In other words, even when the questioner is not communicating with a responder, the responder can receive the radio wave transmitted from the questioner. In this case, the electric field intensity is higher in the communication area than outside thereof. As a result, it is possible to detect the advance of a responder into the communication area when a predetermined electric field intensity is exceeded by the responder. Once the advance into a communication area of a responder is detected in this way, it is easy to obtain the advance time information representing the time a responder advances into the communication area or the coverage information representing the distance covered by the responder after advancing into the communication area.

Further, the advance into a communication area by a responder can be detected by reading the bar code information optically recorded or the magnetic information magnetically recorded by a device installed on the ground in order to specify the communication area. In other words, detection of the advance of a responder into the communication area can be detected by the particular responder reading the information optically or magnetically as well as by the responder detecting the electric field intensity. Also, a car tread or similar structure for detecting the vehicle arrival may be provided on the ground so that the questioner notifies a responder of the advance thereof into the communication area when the vehicle passes the car tread. As a result, the responder may detect the advance into the communication area according to the notification.

The advance of a responder into the communication area is performed with the speed of the vehicle on which the responder is mounted. Consequently, the time a responder is expected to pass the communication area varies with the speed of the vehicle on which the responder is mounted. Therefore, the advance information representing the vehicle speed and the time at which the responder advanced into the communication area may be used as the status information. Yet another alternative status information may be the running information including the speed and the distance covered by the responder at which the responder has run after advance into the communication area. In this fashion, either the time at which the responder advances into the communication area and the vehicle speed or the distance coverage after advancing into the communication area and the vehicle speed can be used to accurately estimate the time the responder is expected to pass the communication area. The vehicle speed change can be used instead of or in addition to the vehicle speed.

In the second aspect of the invention, the questioner transmits the communication time information representing the time of communication from the questioner as status information. Each responder returns at least the received information as it is, i.e., at least information containing the communication time information sent from the questioner. This communication time information may be the transmission number updated for each transmission by the questioner. Another communication time information that can be used is the time of transmission from the questioner. Consequently, the information returned from each responder contains at least the communication time information sent from the questioner. As a result, each communication time information returned from a plurality of responders contains the communication time information indicating the temporal order of the communication sent from the questioner. The order of the communication time among the responders can thus be determined from the communication time information. The questioner checks the temporal order of the communication indicated by the communication time information contained in the information returned from each responder, and can determine a responder that has returned the oldest communication time information as an object of communication. The responder that has returned the oldest communication time information is the one expected to pass the communication area at the earliest time and requires communication with top priority. Thus, this responder is matched with the questioner as the optimal object of communication.

Other status information that can be used is the distance coverage information representing the distance covered by a responder after it advanced into the communication area. If each responder transmits the distance coverage information, the questioner can determine the distance remaining to be covered until the particular responder passes through the communication area. Once the remaining distance is determined for each responder to pass through the communication area in this way, a responder expected to pass through the communication area at the earliest time can be accurately determined.

The above and other objects, features and advantages of the present invention will become apparent from the following description and the appended claims, taken in conjunction with the accompanying drawings in which preferred embodiments of the present invention are shown by way of illustrative example.

BRIEF DESCRIPTION OF THE DRAWINGS

The invention will now be described with reference to the accompanying drawings, wherein.

DESCRIPTION OF THE PREFERRED EMBODIMENTS

An embodiment of the present invention will be described in detail below with reference to the accompanying drawings. According to this embodiment, the present invention is applied to an automatic charge collection system comprising a plurality of vehicle-mounted units as responders and a ground unit as a questioner installed on the ground at the inlet gate and the outlet gate of a toll road or the like, wherein the traffic section (route) covered by a vehicle and the vehicle type are discriminated by radio communication between the vehicle-mounted unit and the ground unit thereby to automatically collect the traffic charge without stopping the vehicle at the inlet gate or the outlet gate, as the case may be.

The first embodiment uses the time at which each vehicle begins transmission (the current time at which the vehicle-mounted unit begins to receive radio wave from the ground unit) in order for the ground unit to select the optimal vehicle-mounted unit in the process of radio communication with a plurality of vehicle-mounted units.

Figure 2:
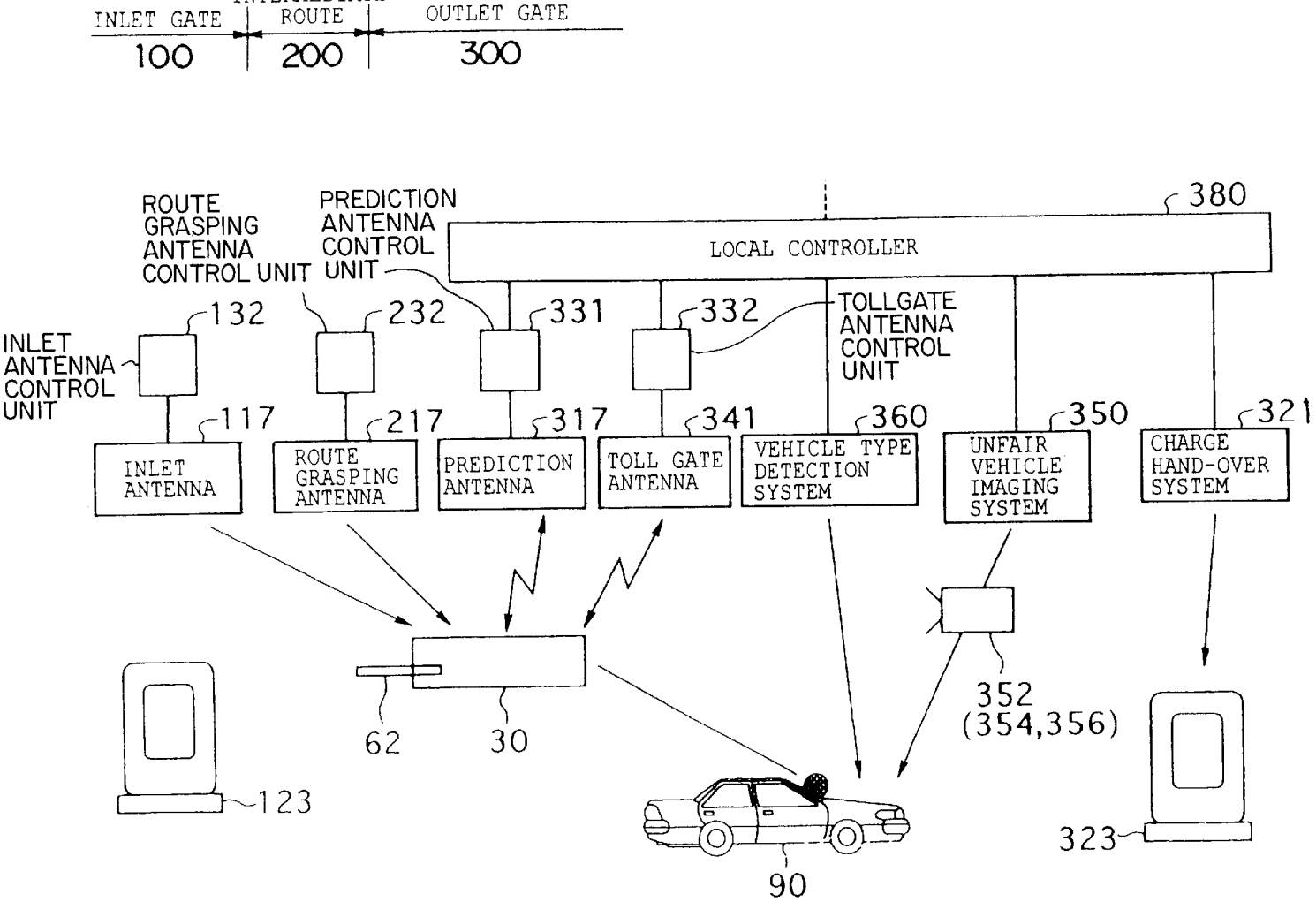
FIG. 2 is a block diagram showing an automatic charge collection system to which the invention is applicable.
Figure 4:
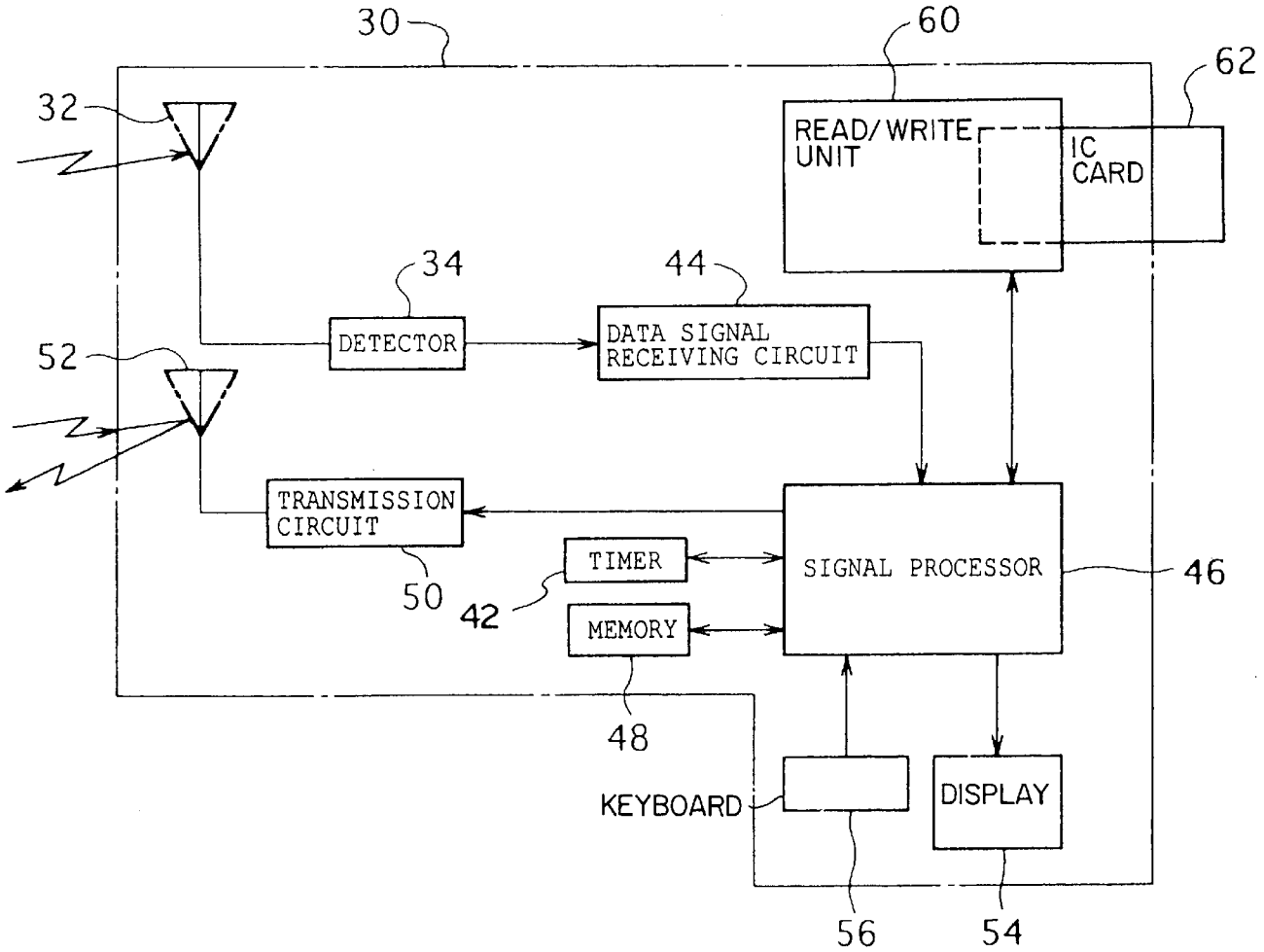
FIG. 4 is a block diagram showing a vehicle-mounted unit according to the first embodiment.

As shown in FIG. 2, a vehicle-mounted unit 30 on a vehicle 90 includes an IC card read/write unit 60 in which an IC card storing outstanding charge information and the like is removably mountable (FIG. 4). This vehicle-mounted unit 30 includes a memory circuit for storing fixed data including an IC code such as the license number and vehicle type information, refers to the outstanding charge information on the IC card 62 mounted in the IC card read/write unit 60, and writes the outstanding charge information in the IC card 62.

The ground equipment, on the other hand, includes a ground unit installed at an inlet gate 100, an intermediate route 200 immediately before or after an interchange, a service area and an outlet gate 300 of a toll road, as described later, for exchanging various information with the vehicle-mounted units 30.

The inlet gate 100 is equipped with a ground unit including an inlet antenna 117 having a flat antenna and an inlet antenna control unit 132 connected to the inlet antenna 117. This inlet antenna control unit 132 is operated to transmit the toll road inlet gate information to the vehicle-mounted unit 30 on the vehicle through the inlet antenna 117 and also to receive signals from the vehicle-mounted unit 30. The inlet gate 100 is equipped with a pass dispenser 123 for issuing a pass to vehicles unable to use the automatic charge collection system and required to hand over the traffic charge as in the prior art.

The intermediate route 200 is equipped with a ground unit including an antenna 217 having a flat antenna for grasping the route of a vehicle and a route grasping antenna control unit 232 connected to the route grasping antenna 217. The route grasping antenna control unit 232 transmits to the vehicle-mounted unit 30 route traversal information (the position of the routine grasping antenna control unit and the like) or the like indicating through the route grasping antenna 217 the route selected by the vehicle from an interchange and the route followed by the vehicle along the toll road.

The outlet gate 300 has arranged therein two types of antenna including a prediction antenna 317 having a flat antenna and a toll gate antenna 341 in order to assure an improved information exchange by radio. The prediction antenna 317 is connected with a prediction antenna control unit 331, and the toll gate antenna 341 is connected with a toll gate antenna control unit 332. The prediction antenna control unit 331 and the toll gate antenna control unit 332 are connected to a local controller 380. The prediction antenna 317, the toll gate antenna 341, the prediction antenna control unit 331 and the toll gate antenna control unit 332 operate as a ground unit according to the invention. The prediction antenna 317 and the prediction antenna control unit 331, however, may be omitted.

The outlet gate 300, on the other hand, is equipped with a vehicle type detection system 360 for discriminating the vehicle type by image processing or the like, an unfair vehicle imaging system 350 connected to a camera 352 for taking a photo of an unfair vehicle trying to pass without paying the charge, and a charge hand-over system 321 for vehicles from which the charge cannot be collected automatically. These systems are controlled collectively by the local controller 380 thereby to process any cases of outstanding charges and to automatically collect the traffic charge according to the vehicle type and the traffic section (route) run by the vehicle.

An example of the general configuration of the intermediate route will be explained in more detail.

Figure 3:
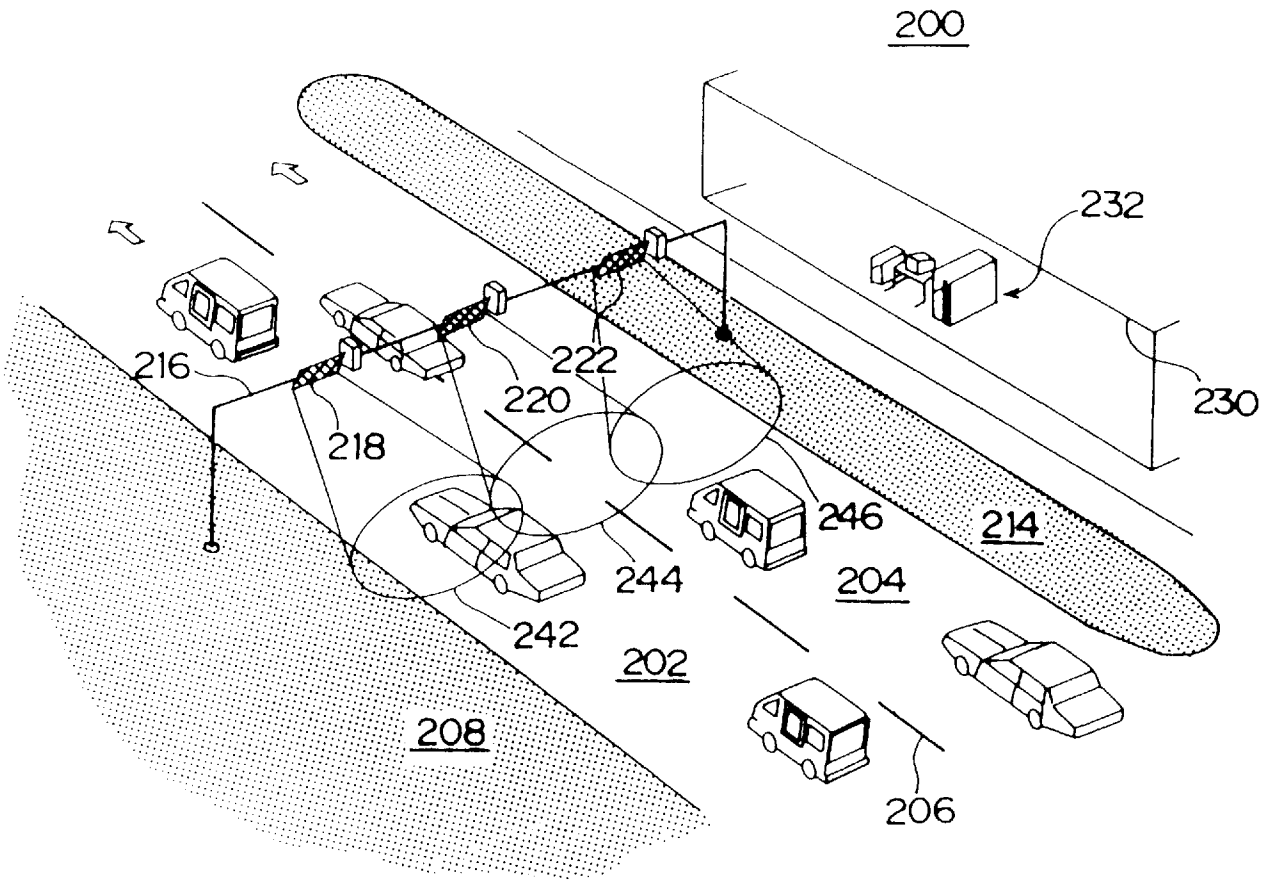
FIG. 3 is a perspective view schematically showing an intermediate route of the automatic charge collection system of FIG. 2.

As shown in FIG. 3, the intermediate route immediately before an interchange of a toll road is formed of two adjacent lanes 202, 204 on the two sides of a white center line 206 between land lots 208 and 214. An arch 216 is hung over the lanes 202, 204 from the lot 208 to the lot 214. Route grasping antennas 218, 220, 222 are mounted on the arch 216. The route grasping antenna 218 located over lane 202 is for exchanging information mainly with vehicles running on lane 202, and the route grasping antenna 222 located over lane 204 exchanges information mainly with the vehicles running on lane 204. A route grasping antenna 220 for exchanging information with vehicles is hung mainly over the lanes 202, 204 above the center line 206 defining the boundary of lanes 202, 204 between the route grasping antennas 218, 222.

The route grasping antenna 218 has a communication area 242 in which information exchange by radio wave is possible with running vehicles. In similar fashion, the route grasping antenna 220 has a communication area 244, and the route grasping antenna 222 a communication area 246. These adjoining communication areas 242, 244 are partially overlapped, and so are the communication areas 244, 246.

A route control center 230 having a route grasping antenna control unit 232 is arranged in the lot 214. The route grasping antenna control unit 232 is connected to the route grasping antennas 218, 220, 222.

Now, the configuration of the vehicle-mounted unit 30 mounted on a vehicle will be explained. As shown in FIG. 4, the vehicle-mounted unit 30 includes a receiving antenna 32 for receiving signals transmitted from the ground unit described later. The receiving antenna 32 is connected to a detector circuit 34 for detecting the modulated wave received by the receiving antenna 32 and producing a data signal. The detector circuit 34 is connected to a signal processing circuit 46 including a microcomputer through a data signal receiving circuit 44.

The signal processing circuit 46 is connected to a memory circuit 48 for storing data such as ID code and vehicle type information and a transmission circuit 50 for transmitting a data signal containing the ID code as a response signal. The transmission circuit 50 modulates an inquiry signal constituting an unmodulated carrier wave received by the transmit-receive antenna 52 with the data signal from the signal processing circuit 46 and returns the resulting signal through the transmit-receive antenna 52.

The signal processing circuit 46 is connected to a display 54 composed of an LCD or a CRT for displaying a reach and a ten-key board 56 for inputting signals such as a selection signal to the signal processing circuit 46. The signal processing circuit 46 is connected to an IC read/write unit 60 in which an IC card 62 is removably mountable. Further, the signal processing circuit 46 is connected with a timer 42 which functions as a built-in clock for indicating the current time. As an alternative to the timer 42, the current time may be measured by a clock in the microcomputer making up the signal processing circuit 46.

The vehicle-mounted unit is always supplied with power from a vehicle-mounted battery for ignition.

The ground unit for communicating with the vehicle-mounted unit 30 will be explained with reference to the one installed in the intermediate route 200. For facilitating the understanding the ground unit, explanation will be made by reference to the route grasping antenna 218 and the route grasping antenna control unit 232 responsible for radio wave exchange with vehicles running on lane 202.

Figure 5:
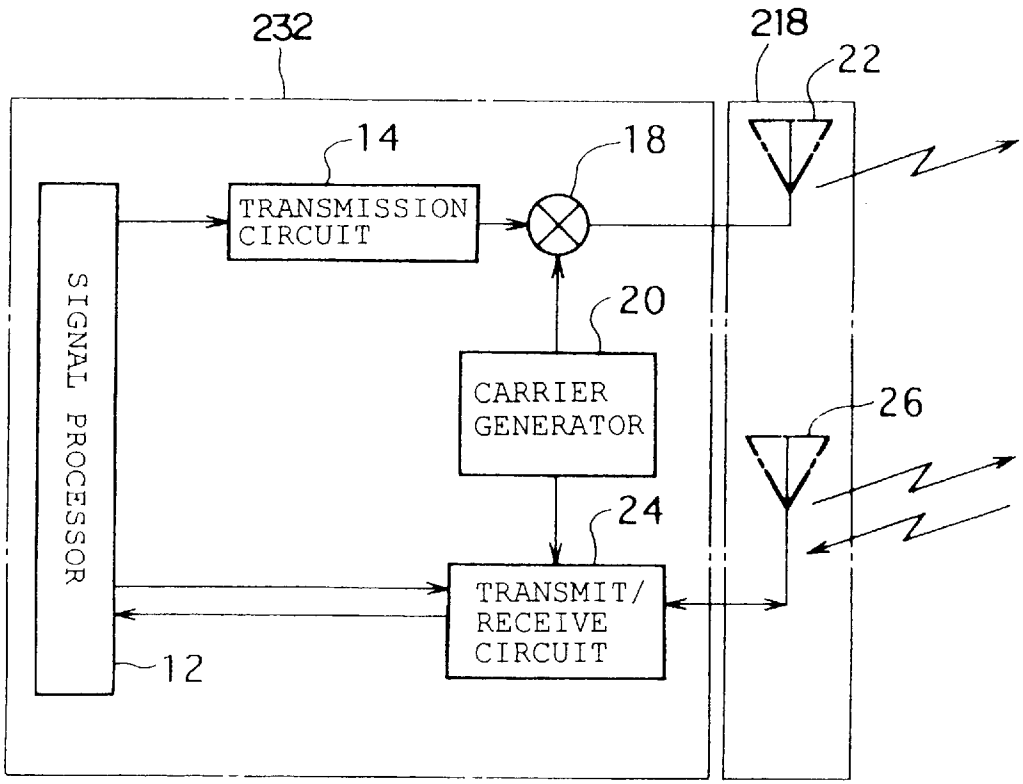
FIG. 5 is a block diagram showing an example of a ground unit according to the first embodiment.

As shown in FIG. 5, the ground unit for vehicles running on lane 202 includes the route grasping antenna 218 and the route grasping antenna control unit 232. The route grasping antenna 218 in turn includes a transmit antenna 22 and a transmit-receive antenna 26. The route grasping antenna control unit 232 includes a signal processing circuit 12 having a microcomputer. The signal processing circuit 12 is connected to a transmission circuit 14 for transmitting a data signal (communication request signal) having an instruction. The transmission circuit 14 is connected to the transmission antenna 22 through a mixer 18. The mixer 18 is connected to a carrier generator 20 for generating a carrier of a predetermined frequency. The mixer 18 mixes the signal input from the transmission circuit 14 with the carrier input from the carrier generator 20, and modulates the carrier input from the carrier generator 20 with the signal input from the transmission circuit 14. The modulated signal wave is transmitted from the transmission antenna 22.

The carrier wave generator 20 is connected to a transmit-receive circuit 24 for retrieving the data signal from the signal modulated and returned from the vehicle-mounted unit 30 shown in FIG. 4 and received by the transmit-receive antenna 26. The transmit-receive circuit 24 is connected to the signal processing circuit 12.

The configuration of other antennas in the intermediate route 200 is similar to that described above and will not be described. The configuration of the antennas and the antenna control units for the inlet gate 100 and the outlet gate 300 are also similar to those described above and will not be described.

A processing routine according to this embodiment will be explained. First, the basic signal transmission and receipt (communication) conducted by a handshake between the vehicle-mounted unit and the ground unit according to the embodiment will be explained briefly with reference to FIGS. 1, 6, 7A and 7B as an example of intermediate route.

Figure 1:
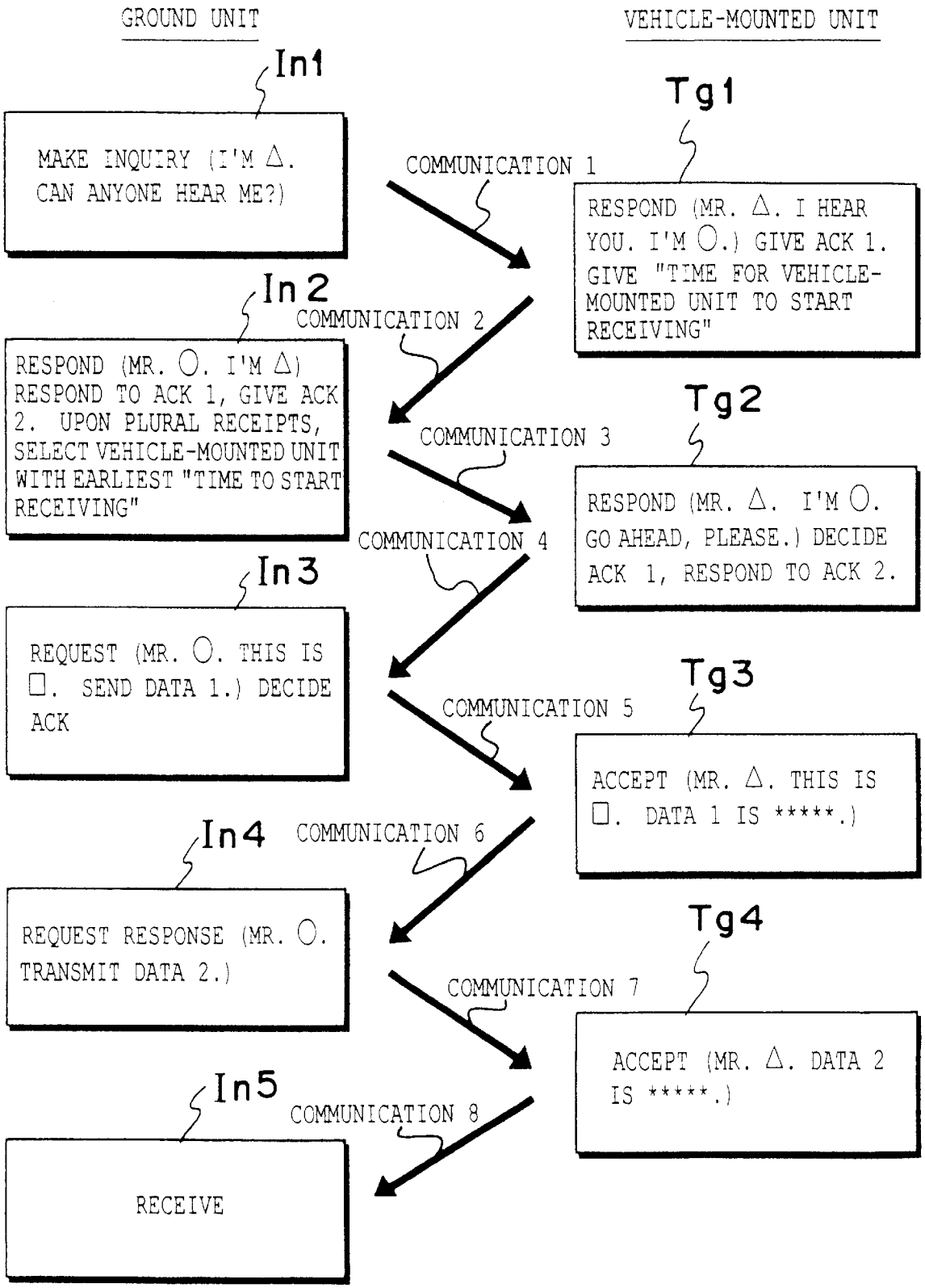
FIG. 1 is a schematic diagram showing the concept of basic signal transmission and receipt (communication) by a handshake conducted between a vehicle-mounted unit and a ground unit according to a first embodiment.
Figure 6:
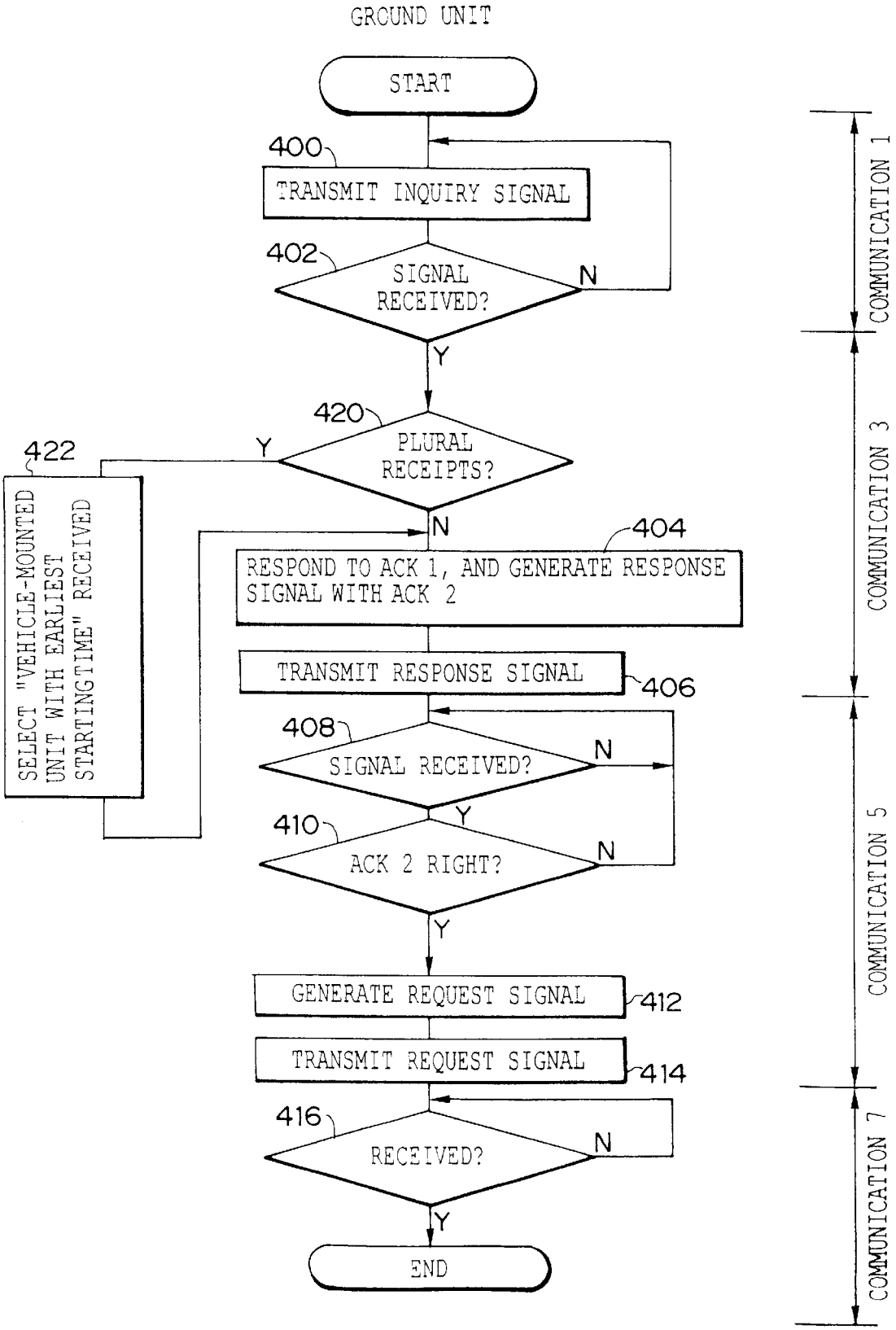
FIG. 6 is a flowchart showing the flow of a processing routine for the ground unit according to the first embodiment.

First, the ground unit installed in the intermediate route, as shown in FIG. 6, transmits an inquiry signal consisting of a continuous wave in step 400 until a response signal is received from the vehicle-mounted unit (corresponding to communication 1 for transmitting the processed data In1 in FIG. 1).

Figure 7A:
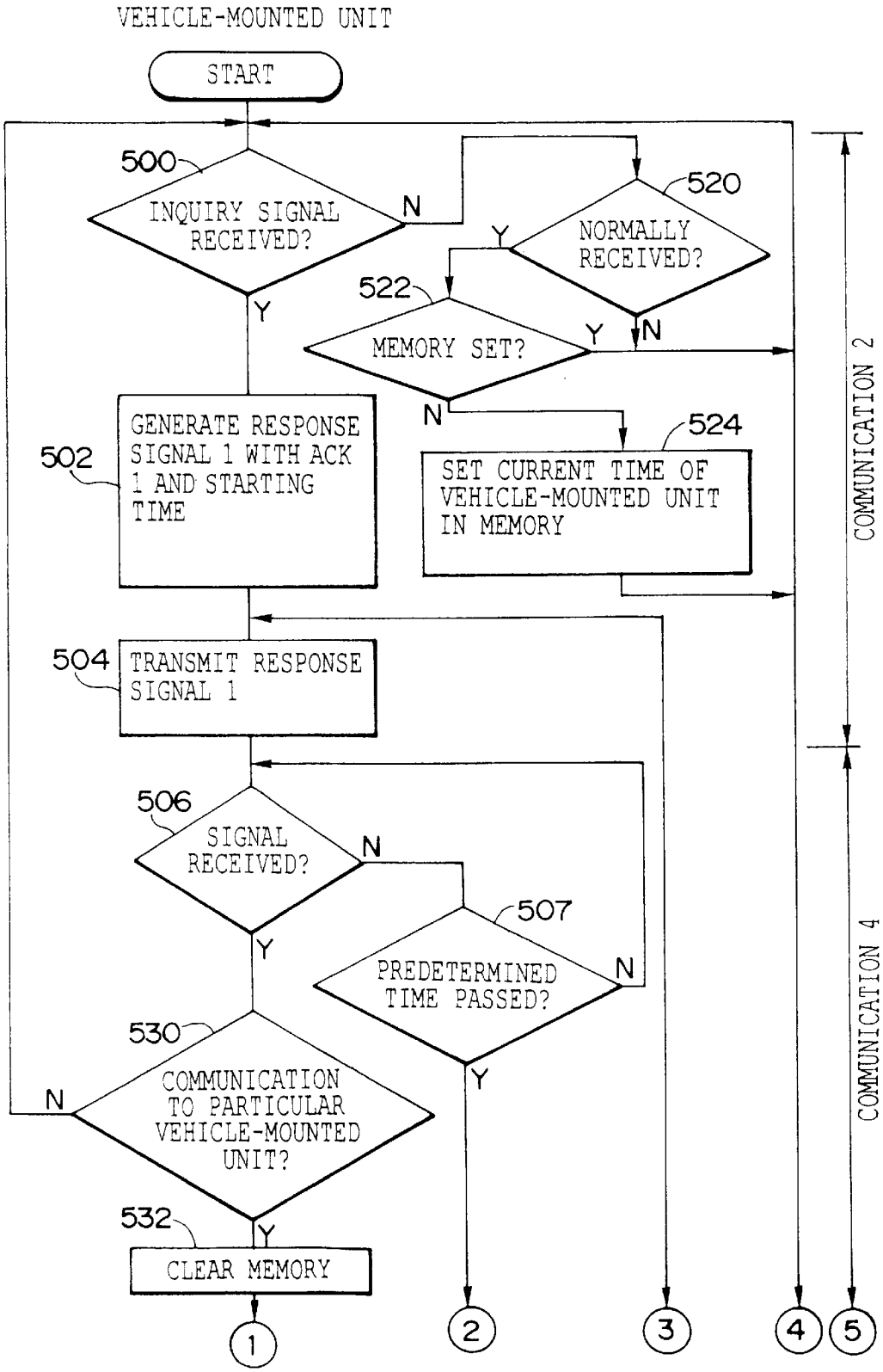
FIGS. 7A and 7B are a flowchart showing the flow of a processing routine for the vehicle-mounted unit according to the first embodiment.

The vehicle-mounted unit decides whether an inquiry signal was received in step 500 as shown in FIG. 7A, and upon decision that an inquiry signal was received, step 502 gives an acknowledgment l as ID information for permitting mutual recognition between the vehicle-mounted unit and the ground unit and conducting the handshake operation. At the same time, a response signal l with the starting time of the vehicle-mounted unit stored in the memory circuit 48 is generated and transmitted in step 504.

In the case where the answer at step 500 is negative and no inquiry signal is received, the process proceeds to step 520. Even in the case where the decision in step 500 is negative and no inquiry signal is received, other communications may be going on from the ground unit. Step 520 therefore decides whether the communication is received normally or not, and if not normal, returns to step 500. In the case where the communication is received normally, on the other hand, the decision is that no inquiry signal is received but other communication is involved. The process then proceeds to step 522 for deciding whether the starting time described later is set in the memory circuit 48 or not. In the case where the starting time is set in the memory circuit 48, it indicates that a vehicle already exists in the communication area. Step 522 therefore gives an affirmative answer, and the process returns to step 500. In the case where the starting time is not set in the memory circuit 48, on the other hand, the process proceeds to step 524, where the current time is read from the timer 42 and set as the starting time in the memory circuit 48. Then the process returns to step 500. In this way, the first receiving time of the vehicle-mounted unit in the communication area of the ground unit is stored in the memory circuit 48. The processing of the vehicle-mounted unit up to this stage corresponds to the communication 2 for transmitting the processed data Tg1 in FIG. 1.

Instead of the decision on the vehicle existence in the communication area described above, a decision may be made as to whether the vehicles are running in a certain sequence by the communication between the vehicle-mounted units of vehicles. The sequence, if any, is stored in the memory circuit 48.

The decision of step 520 may be changed to make decision as to whether a vehicle-mounted unit is in the communication area or not. The decision made by a vehicle-mounted unit on the existence of the vehicle-mounted unit in the communication area can be made by a prediction antenna and reporting means installed on the ground for recording optical bar code information and magnetic information for displaying the boundary of a communication area. The decision may be made using the radio signal received from the prediction antenna or the magnetic information or bar code information read and detected.

Further, the vehicle-mounted unit may receive an inquiry signal first from the ground unit. Therefore, steps 520 to 524 may be added between steps 500 and 502 so that the current time of the vehicle-mounted unit is stored as a starting time in the memory circuit when an inquiry signal is received first by the vehicle-mounted unit as a signal from the ground unit.

When step 402 of FIG. 6 decides that a response signal 1 is received from the vehicle-mounted unit, the process proceeds to step 420 where the ground unit decides whether a response signal is received from a plurality of vehicle-mounted units or not. In the case where the answer in step 420 is negative, the existence of only the particular vehicle in the communication area is indicated, and therefore the next step 404 generates a response signal including the response to the acknowledgment 1 transmitted from the vehicle-mounted unit, the acknowledgment of the ground unit for the handshake operation, and the acknowledgment 2 in terms of the antenna number of the antenna for performing actual communication, for example. This signal is transmitted in step 406 (corresponding to the communication 3 for transmitting the processed data In2 in FIG. 1).

When the ground unit receives a response signal from a plurality of vehicle-mounted units, step 420 makes an affirmative decision, and then step 422 selects the vehicle-mounted unit with the earliest starting time among the vehicle-mounted units from which a plurality of response signals have been received as an object of communication. In the case where there are a plurality of vehicle-mounted units having the same stating time, a vehicle-mounted unit is selected according to a predetermined order of priority or by a random number generated for this purpose. Even when a plurality of vehicle-mounted units are present in a communication area and the ground unit receives a response signal from a plurality of vehicle-mounted units, therefore, the ground unit, which has received the current time of the vehicle-mounted units corresponding to the communication start time of each vehicle-mounted unit as the starting time thereof, can select a vehicle-mounted unit with the earliest starting time expected to pass the communication area at the earliest time.

The vehicle-mounted unit decides whether a response signal is received in step 506 of FIG. 7A, and when no response signal is received, decides on a negative answer. The process then proceeds to step 507. Step 507 decides whether a predetermined time has passed or not, and if the predetermined time is not passed, the process returns to step 506. In the case where a predetermined time has passed without receiving a response signal, on the other hand, step 507 decides on an affirmative answer, followed by step 509 for deciding whether a predetermined number (three times according to the embodiment) of the response signal transmissions is to be repeated (retried) or not. If the number of retrials is less than a predetermined number, the answer in step 509 is affirmative and the process returns to step 504. In the case where no response signal is not received even after a predetermined number of retrials, by contrast, step 509 decides on a negative answer and the process returns to step 500. The process described above is then reexecuted from the first step.

In the case where a response signal is received and the decision at step 506 is affirmative, the next step 530 decides whether the received response signal is for communication to the particular vehicle-mounted unit. If the answer is negative as it is not destined to the particular vehicle-mounted unit, the process returns to step 500. In the case where the decision at step 530 is the communication to the particular vehicle-mounted unit, by contrast, step 532 resets the starting time of the memory circuit 48, and the process is passed to step 508. Step 508 decides whether the acknowledgment 1 included in the response signal coincides with the acknowledgment 1 transmitted. If the acknowledgment 1 fails to coincide and the answer is negative, then the process proceeds to step 509, where the above-mentioned process is executed for repeating a predetermined number of retrials. In the case where the acknowledgment 1 coincides and the decision at step 508 is affirmative, on the other hand, the response to the transmission of the acknowledgment 1 is indicated, so that a response signal 2 to the acknowledgment 2 transmitted from the ground unit is generated in step 510 and transmitted at step 512 (corresponding to the communication 4 for transmitting the processed data Tg2 in FIG. 1).

The ground unit repeatedly executes step 408 of FIG. 6 until a response signal is received. When a response signal is received and step 408 decides on an affirmative answer, then the process proceeds to step 410. Step 410 decides whether the acknowledgment 2 included in the response signal coincides with the transmitted acknowledgment 2. If the answer is negative, the process is passed to step 408. In the case where the acknowledgment 2 coincides and step 410 makes an affirmative decision, on the other hand, the received signal is a response to the transmission of the acknowledgment 2 and it is decided that the vehicle-mounted unit and the ground have mutually recognized. Deciding that a handshake is established at this time, step 412 generates a request signal for requesting the data transmission from the vehicle-mounted unit, followed by step 414 for transmitting the data (corresponding to the communications 5, 7 for transmitting the processed data In3, 4 in FIG. 1). The signal receipt in step 408 may be such that as executed for the vehicle-mounted unit, the process may be returned to step 400 depending on whether the retrials are performed a predetermined number of times (three, for example) after the lapse of a predetermined time. In such a case, even when the decision at step 410 is negative, the above-mentioned process is desirably executed for repeating a predetermined number of retrials. By doing so, the ground unit is prevented from continuing the process while waiting for a signal.

When the above-mentioned request signal is generated, it may contain the information on the ground unit according to the position of the inlet gate, the intermediate route and the outlet gate. The information on the ground unit for the inlet gate includes the lane number, the inlet number and the time (year, month, date, hours, minutes). The information for the intermediate route includes the lane number, the route number and the time. Also, the information for the outlet gate includes the lane number, the toll gate number and the time (year, month, data, hours and minutes).

Figure 7B:
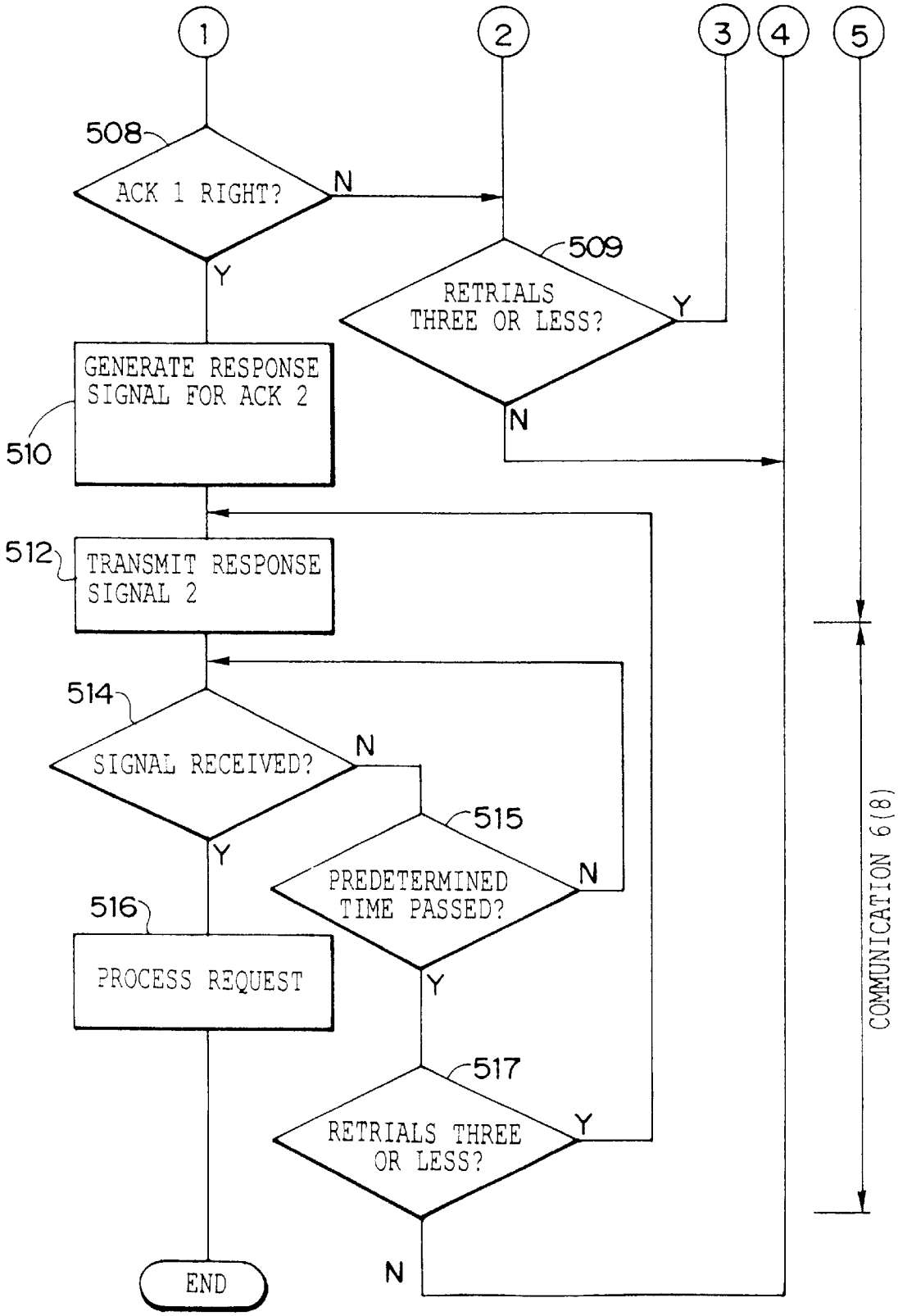

When the vehicle-mounted unit receives a signal from the ground unit, step 514 in FIG. 7B makes an affirmative decision, and step 516 transmits the data corresponding to the request signal received (corresponding to the communication 6, 8 for transmitting the processed data Tg3, Tg4). Upon complete transmission of the data, the handshake is cancelled to thereby to terminate the routine of FIGS. 7A and 7B. Step 514 decides whether the signal is received or not, and upon an affirmative decision, the next step 516 transmits data. In the absence of signal receipt, however, the decision is negative, and the process proceeds to step 515. Step 515 decides whether a predetermined time has passed or not, and if the predetermined time is not passed, the process returns to step 514. If the predetermined time has passed in the absence of signal receipt, on the other hand, step 515 decides on an affirmative answer, followed by step 517 for deciding whether the transmission of the response signal 2 (retrial) is repeated a predetermined number of times (three according to the embodiment). In the case where the number of retrials is less than the predetermined number, the decision is affirmative and the process returns to step 512. In the case where no signal is received after the predetermined number of retrials, by contrast, step 517 decides on a negative answer, and the process returns to step 500 to resume the execution from the beginning. In other words, the handshake is cancelled in the case where the signal is not received after a predetermined number of retrials.

The data transmitted from the vehicle-mounted unit is the vehicle information including the license number, the vehicle type and the number of axles for the inlet gate, or the license number and the inlet number for preventing an unfair conduct for the intermediate route, or the vehicle information including the license number, the vehicle type and the number of axles, the account outstanding on the cash card or the prepaid card and the inlet number used for calculating the charge for the outlet gate.

The ground unit executes step 416 of FIG. 6 repeatedly until the data is received (corresponding to the processed data In5 in FIG. 1), and upon receipt of the data, the handshake is cancelled, thereby terminating the routine of FIG. 6. In step 416 for receiving data, the data may not be transmitted from the vehicle-mounted unit in spite of the transmission of a request signal. As executed for the vehicle-mounted unit, therefore, the process may return to step 400 depending on whether a predetermined number of retrials are carried out after the lapse of a predetermined length of time.

As described above, according to this embodiment, even when a plurality of vehicle-mounted units exist in the communication area of the ground unit and a response signal is received from a plurality of vehicle-mounted units by the ground unit, the vehicle-mounted unit transmitting the earliest starting time it reaches the communication area is set as an object of communication. It is therefore possible to establish a communication with a vehicle-mounted unit expected to pass the communication area at the earliest time. As a consequence, the communication by the ground unit with a vehicle-mounted unit (vehicle) having a small margin of time before passing the communication area is established quickly, thereby assuring an improved communication between the vehicle-mounted unit and the ground unit.

Also, if the timer for producing the starting time is processed in software fashion by calculating the starting time from the count on the CPU clocks and using the result thereof, then the system configuration is not required to be changed. The invention thus can be easily embodied without changing the conventional system configuration.

Now, a second embodiment will be explained. The second embodiment is intended to detect the vehicle expected to pass the communication area at the earliest time from the distance coverage of the vehicle. In this embodiment which is similarly configured as the first embodiment, the same component parts as the corresponding ones of the first embodiment are denoted by the same reference numerals as in the first embodiment and will not be described in detail, only the different component parts being described below.

Figure 8:
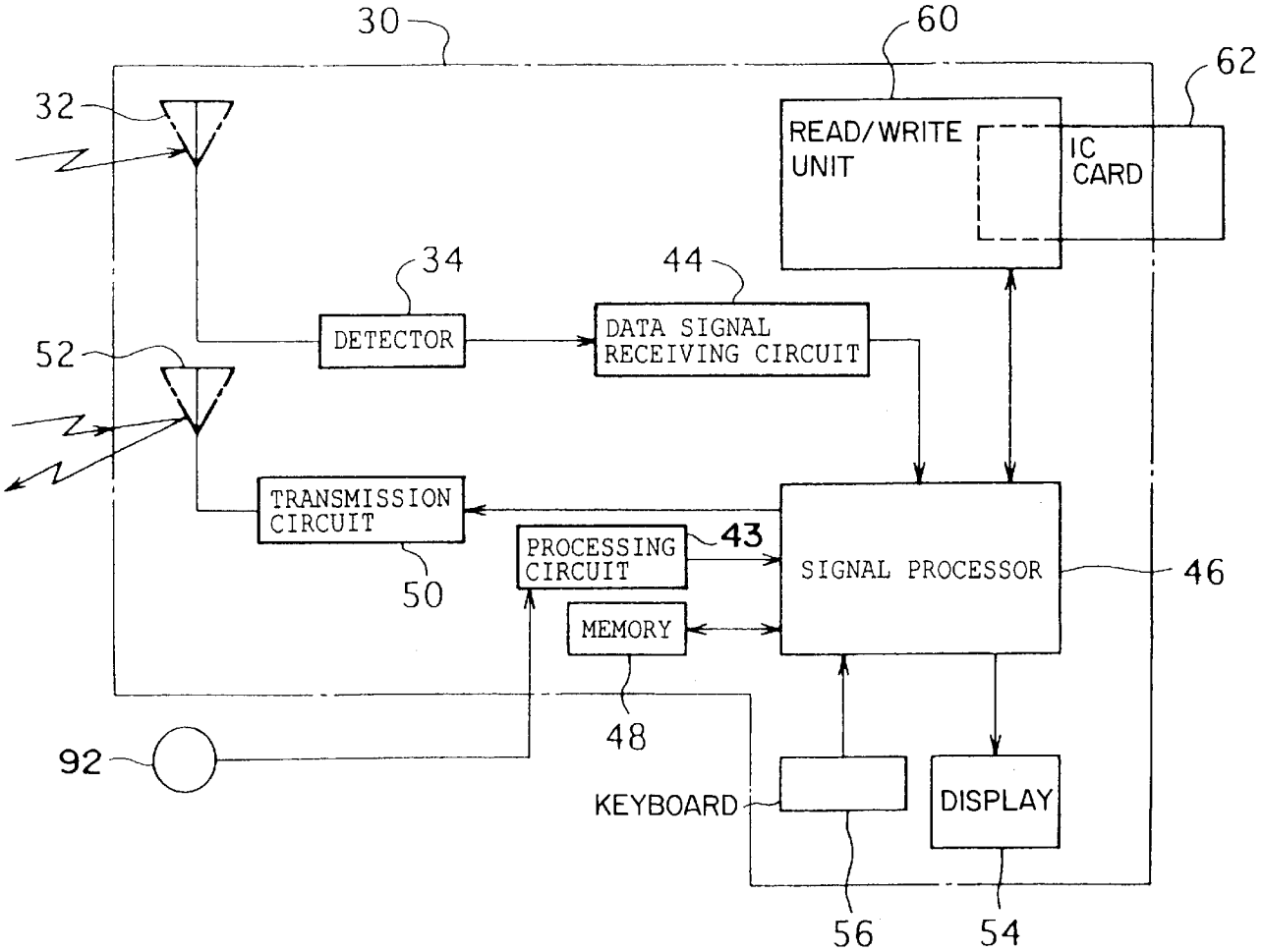
FIG. 8 is a block diagram showing a vehicle-mounted unit according to a second embodiment.

First, a configuration of the vehicle-mounted unit 30 mounted on a vehicle according to this embodiment will be described. As shown in FIG. 8, the vehicle-mounted unit 30 includes a processing circuit 43. This processing circuit 43 is connected to a signal processing circuit 46 on the one hand and to a distance coverage sensor 92 on the other. The coverage sensor 92 is for outputting a signal corresponding to the distance covered and operates in such as to detect a pulse signal corresponding to the wheel revolutions or in such a manner as to detect a distance-related pulse signal coupled to a map meter incorporated in the speed meter. The processing circuit 43 includes a counter circuit for counting the input pulses and having a memory for temporarily holding the count value C. The input pulse signals begin to be counted in accordance with a command from the signal processing circuit 46, and the count value C of the counter circuit is output to the signal processing circuit 46. The coverage for one count unit is measured in advance. The count value C input to the signal processing circuit 46 corresponds to the distance coverage after a command is issued from the signal processing circuit 46. The processing circuit 43 may convert the pulse signal into a digital signal having a high level and a low level, and the signal processing circuit 46 may calculate the distance coverage using the digital signal.

The processing according to this embodiment will be explained with reference to FIGS. 9 to 11A and 11B. The ground unit installed in the intermediate route transmits an inquiry signal including a continuous wave in step 400 until a response signal is received from the vehicle-mounted unit as shown FIG. 10 (corresponding to the communication 1 for transmitting the processed data In1 in FIG. 9).

Upon receipt of an inquiry signal (affirmative decision in step 500 of FIG. 11A), the vehicle-mounted unit gives the acknowledgment 1 as identification information for enabling the vehicle-mounted unit and the ground unit to recognize and also to conduct the handshake with each other. At the same time, a response signal 1 additionally including the count value C representing the distance coverage stored in the memory circuit 48 is generated as described later, and is transmitted in the next step 504.

In the case where the decision in step 500 is negative and the inquiry signal is not received, on the other hand, the process proceeds to step 520. Even when the decision in step 500 is negative and the inquiry signal is not received, however, the possibility exists of other communication from the ground unit. Therefore, step 520 decides whether the communication is normally received or not, and if not, the process returns to step 500. In the case where the communication is normally received, on the other hand, the decision is made that the inquiry signal is not received but other communication exists. The process thus proceeds to step 526 for deciding whether the counter circuit of the processing circuit 43 is operating. If the counter circuit is in operation, step 526 makes an affirmative decision followed by returning to step 500 since a vehicle-mounted unit already exists in the communication area. In the case where the counter has yet to operate, on the other hand, the process proceeds to step 528, and after a command is issued for starting the counter circuit of the processing circuit 4,3, returns to step 500. In this way, the coverage after the vehicle-mounted unit advances into the communication area is measured. In other words, the count value C is always updated in the communication area and read to detect the distance coverage. The aforementioned processing for the vehicle-mounted unit corresponds to the communication 2 for transmitting the processed data Tg1*b* in FIG. 9.

When the ground unit receives the response signal 1 from the vehicle-mounted unit (affirmative decision in step 402 of FIG. 10), the process proceeds to step 420 for deciding whether a response signal is received from a plurality of vehicle-mounted units. In the case where the decision of step 420 is negative, it indicates that the particular vehicle-mounted unit is the only unit existing in the communication area. Therefore, the next step 404 generates a response signal as described above, and this signal is transmitted in the next step 406 (corresponding to the communication 3 for transmitting the processed data In2*b* in FIG. 9).

In the case where the ground unit receives a response signal from a plurality of vehicle-mounted units, step 420 makes an affirmative decision, and step 424 selects a vehicle-mounted unit with the longest coverage among the vehicle-mounted units from which a plurality of responses have been received, i.e., the vehicle-mounted unit with the largest count value C as an object of communication. In the case where a plurality of vehicle-mounted units have the same coverage, a vehicle-mounted unit is selected according to a predetermined order of priority or by a random number specifically generated for this purpose. As a result, even when a plurality of vehicle-mounted units exist in the communication area and the ground unit receives a response signal from a plurality of vehicle-mounted units, a vehicle-mounted unit is selected which has the longest coverage in the communication area and which is expected to pass the communication area at the earliest time.

Figure 9:
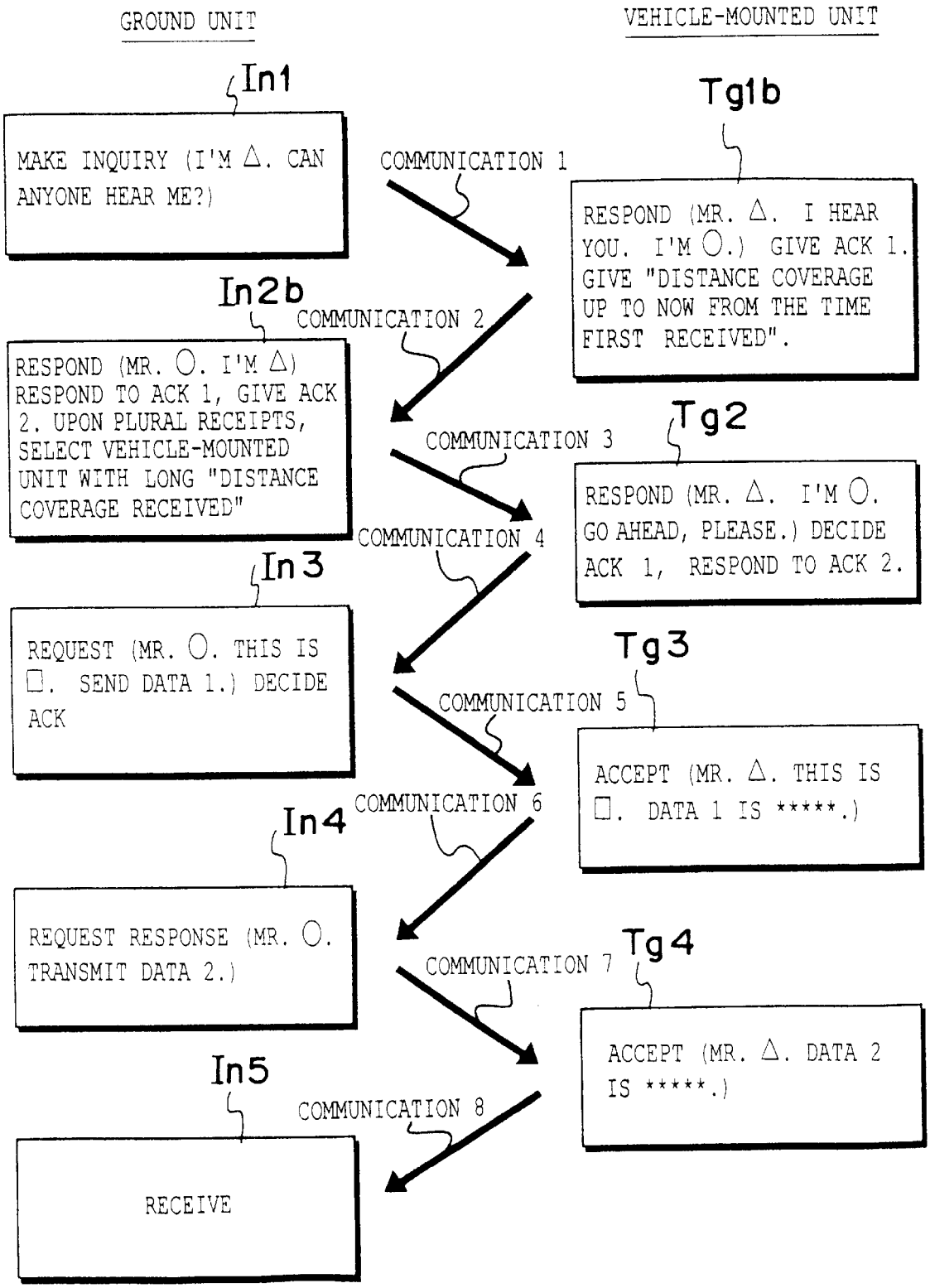
FIG. 9 is a schematic diagram showing the concept of basic signal transmission and receipt (communication) by a handshake conducted between a vehicle-mounted unit and a ground unit according to the second embodiment.
Figure 10:
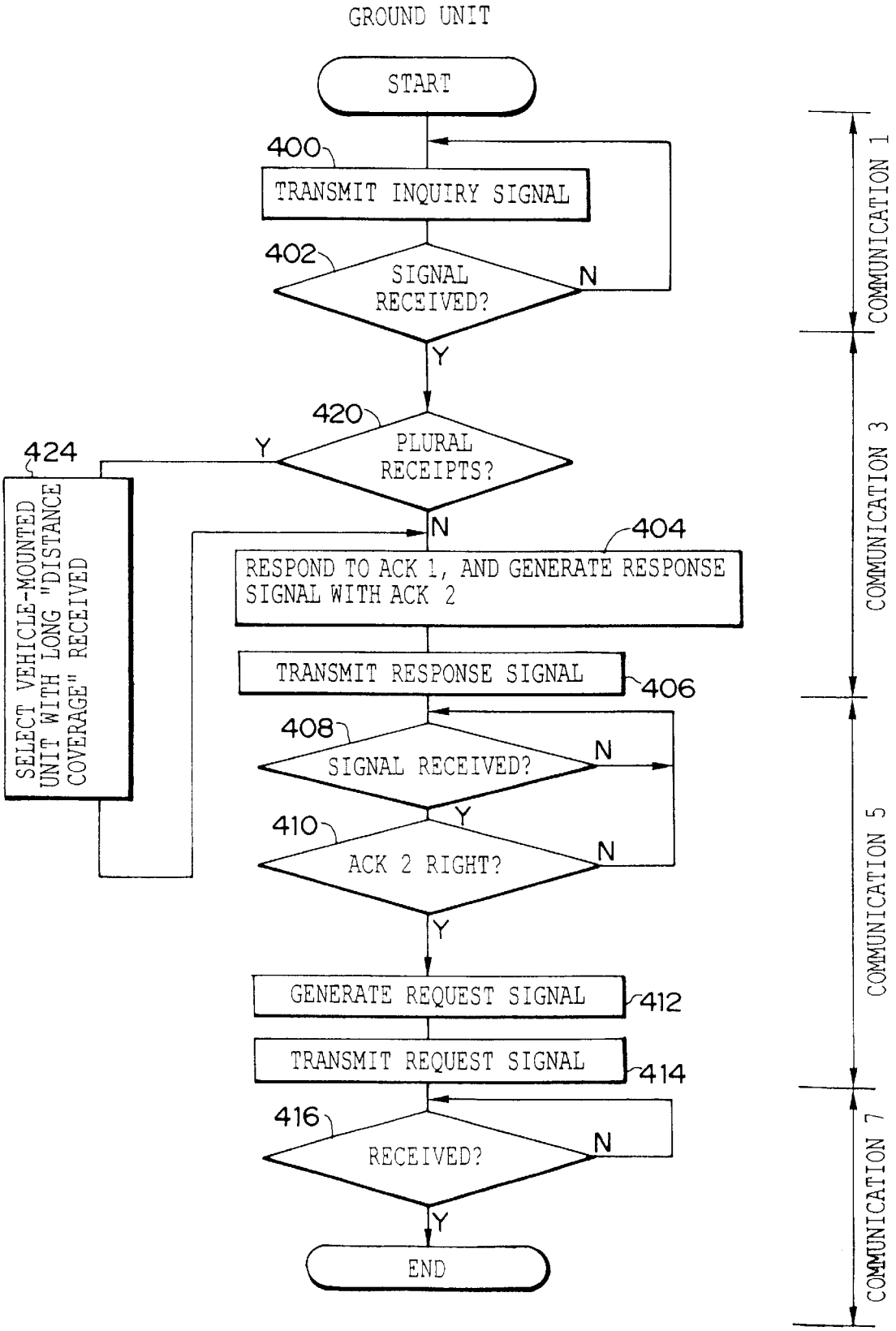
FIG. 10 is a flowchart showing the flow of a processing routine for the ground unit according to the second embodiment.
Figure 11A:
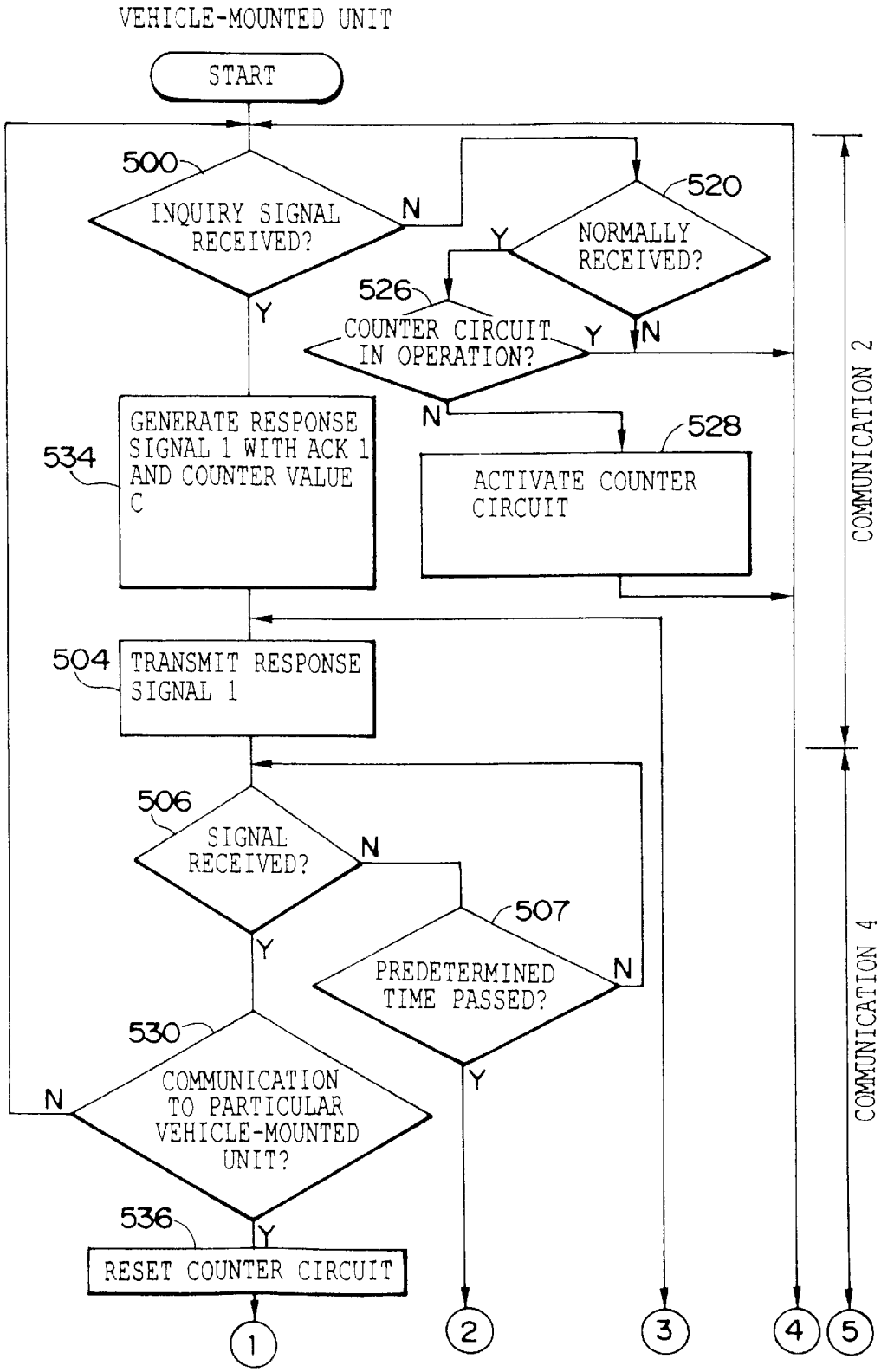
FIGS. 11A and 11B are a flowchart showing the flow of a processing routine for the vehicle-mounted unit according to the second embodiment.
Figure 11B:
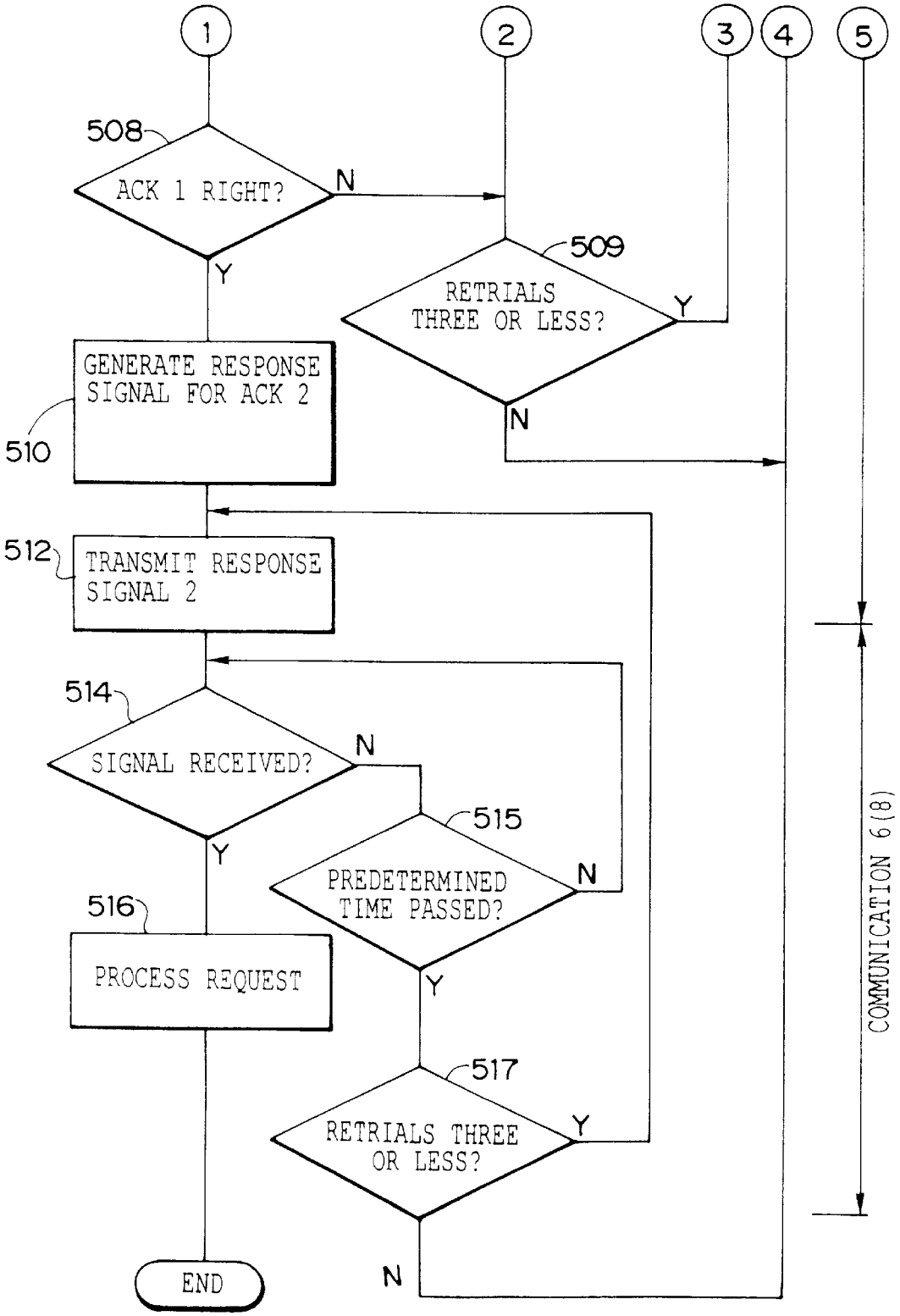

As one of the processes corresponding to the communication 4 for transmitting the processed data Tg2 in FIG. 9 for a vehicle-mounted unit, assume that step 506 of FIG. 11A makes an affirmative decision that a response signal is received, followed by step 530 deciding that the communication is directed to the particular vehicle-mounted unit. Then step 536 resets the counter circuit of the processing circuit 43, and the process proceeds to step 508.

The process from step 508 corresponding to the communications 6, 8 for transmitting the processed data Tg3, Tg4 of FIG. 9 is similar to that of FIG. 7, and therefore will not be described any further. Also, the process including and subsequent to step 408 in FIG. 10 corresponding to the processed data In5 and the process corresponding to the communications 5, 7 for transmitting the processed data In3, 4 of FIG. 7 for the ground unit are similar to the process of FIG. 6, and therefore will not be described any further.

As described above, according to this embodiment, even when a plurality of vehicle-mounted units exist in the communication area of the ground unit and a response signal is received from a plurality of vehicle-mounted units by the ground unit, the distance covered within the communication area is transmitted from each of the vehicle-mounted units. A vehicle-mounted unit having the longest coverage can thus be set as an object of communication, thereby making possible quick establishment of communication with a vehicle-mounted unit having the longest distance coverage and expected to pass the communication area at the earliest time.

Further, the vehicle expected to pass the communication area at the earliest time is selected on the basis the distance covered in the communication area. Therefore, the timing error due to vehicle speed variations up to the time of vehicle selection can be suppressed. As a result, even in the case where vehicles pass the communication area at different speeds, a vehicle-mounted unit expected to pass the communication at the earliest time can be selected securely as an object of communication.

Now, a third embodiment of the invention will be explained. The third embodiment is intended to detect from the electric field intensity that a vehicle (vehicle-mounted unit) has reached a communication area. The third embodiment has a similar configuration as the above-mentioned embodiments, and therefore the same component parts as those in the preceding embodiments will be denoted by the same reference numerals respectively, and will not be described any further. The description below therefore is limited to component parts not included in the previous embodiments.

Figure 12:
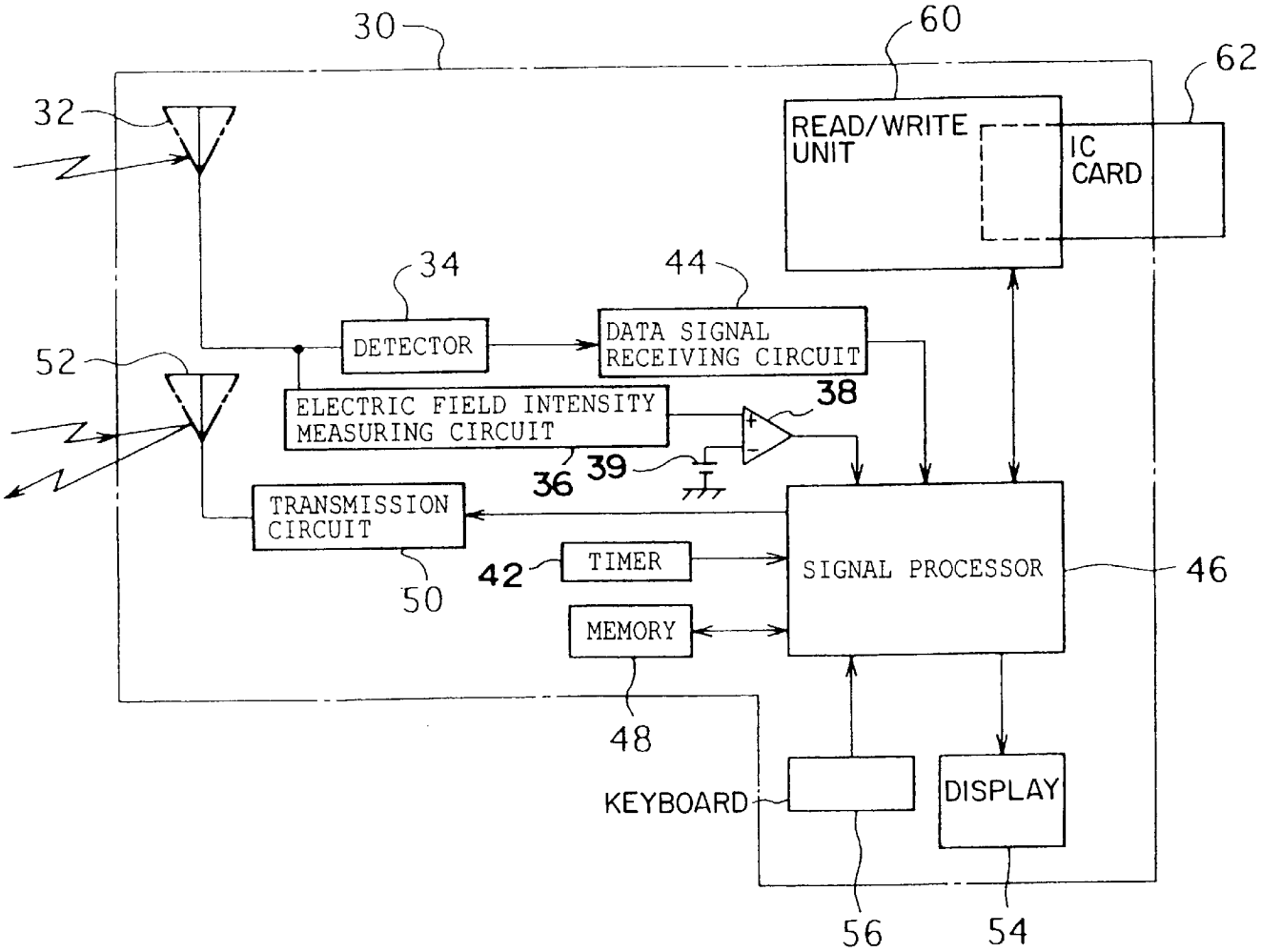
FIG. 12 is a block diagram showing a vehicle-mounted unit according to a third embodiment;.

First, the configuration of the vehicle-mounted unit 30 mounted on a vehicle according to this embodiment will be explained. As shown in FIG. 12, the vehicle-mounted unit 30 is connected to an antenna 32 for receiving a signal sent from the ground unit and an electric field intensity measuring circuit 36 for measuring the electric field intensity around the receiving antenna 32. The electric field intensity measuring circuit 36 is connected through a comparator 38 to the electric field intensity measuring circuit 46. The comparator 38 has an input terminal thereof connected with the electric field intensity measuring circuit 36 and the other input terminal thereof connected to a power supply 39. The power supply 39 functions as a threshold setting circuit for setting a threshold level for raising the output signal to high level when the output signal of the electric field intensity measuring circuit 36 exceeds a threshold level. As a result, a high-level signal is input to the signal processing circuit 46 when the output signal of the electric field intensity measuring circuit 36 exceeds the voltage determined by the power supply 39, i.e., when the electric field intensity exceeds a predetermined value. Also, the signal processing circuit 46 is connected to a timer 42 functioning as a built-in timer for indicating the current time.

Now, the processing according to the present embodiment will be explained with reference to FIGS. 13 to 15A and 15B. The ground unit installed in the intermediate route transmits an inquiry signal including a continuous wave in step 400 until a response signal is received from the vehicle-mounted unit as shown in FIG. 14 (corresponding to the communication for transmitting the processed data In1 of FIG. 13).

Figure 15A:
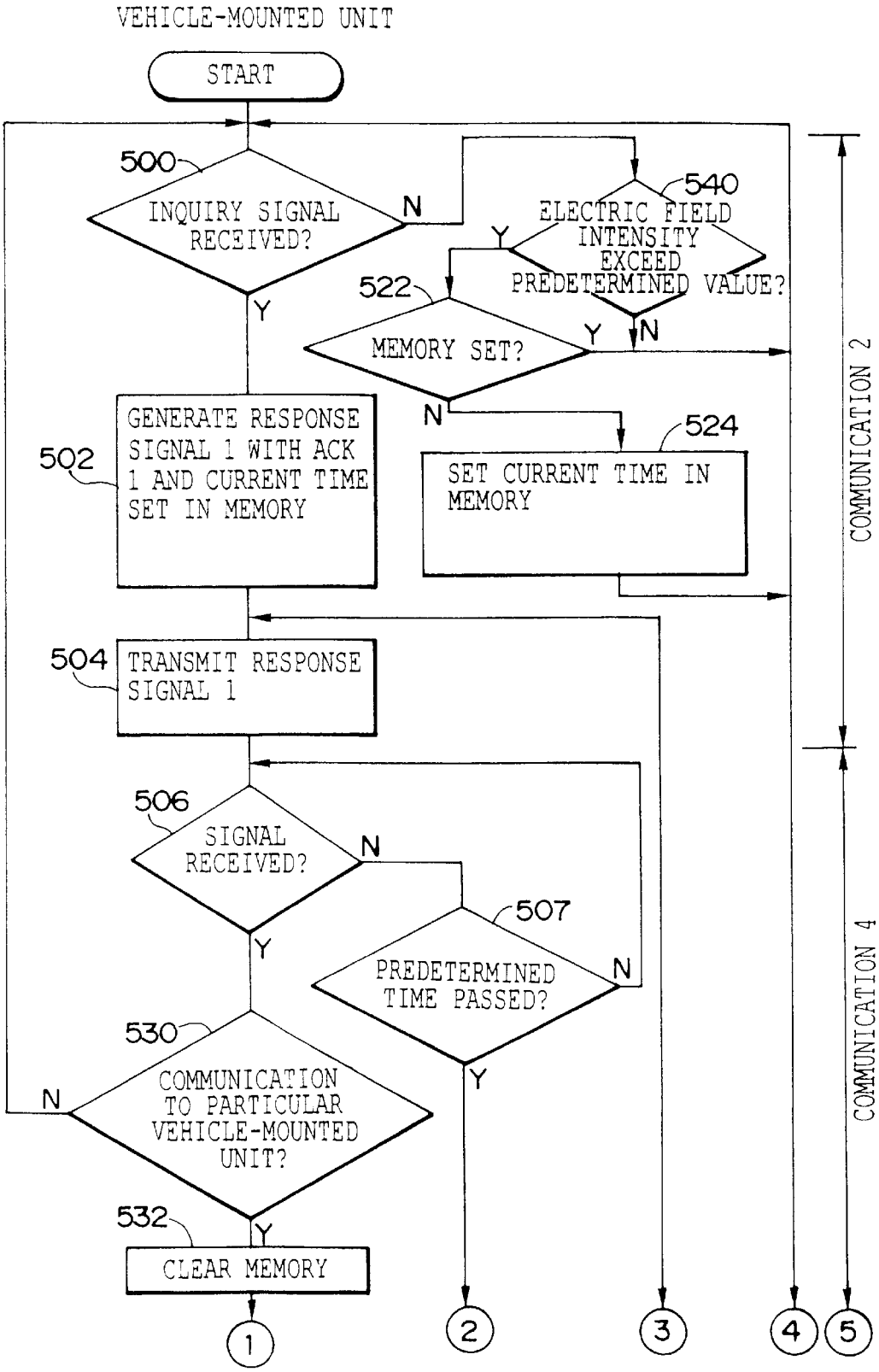
FIGS. 15A and 15B are a flowchart showing the flow of a processing routine for the vehicle-mounted unit according to the third embodiment.
Figure 15B:
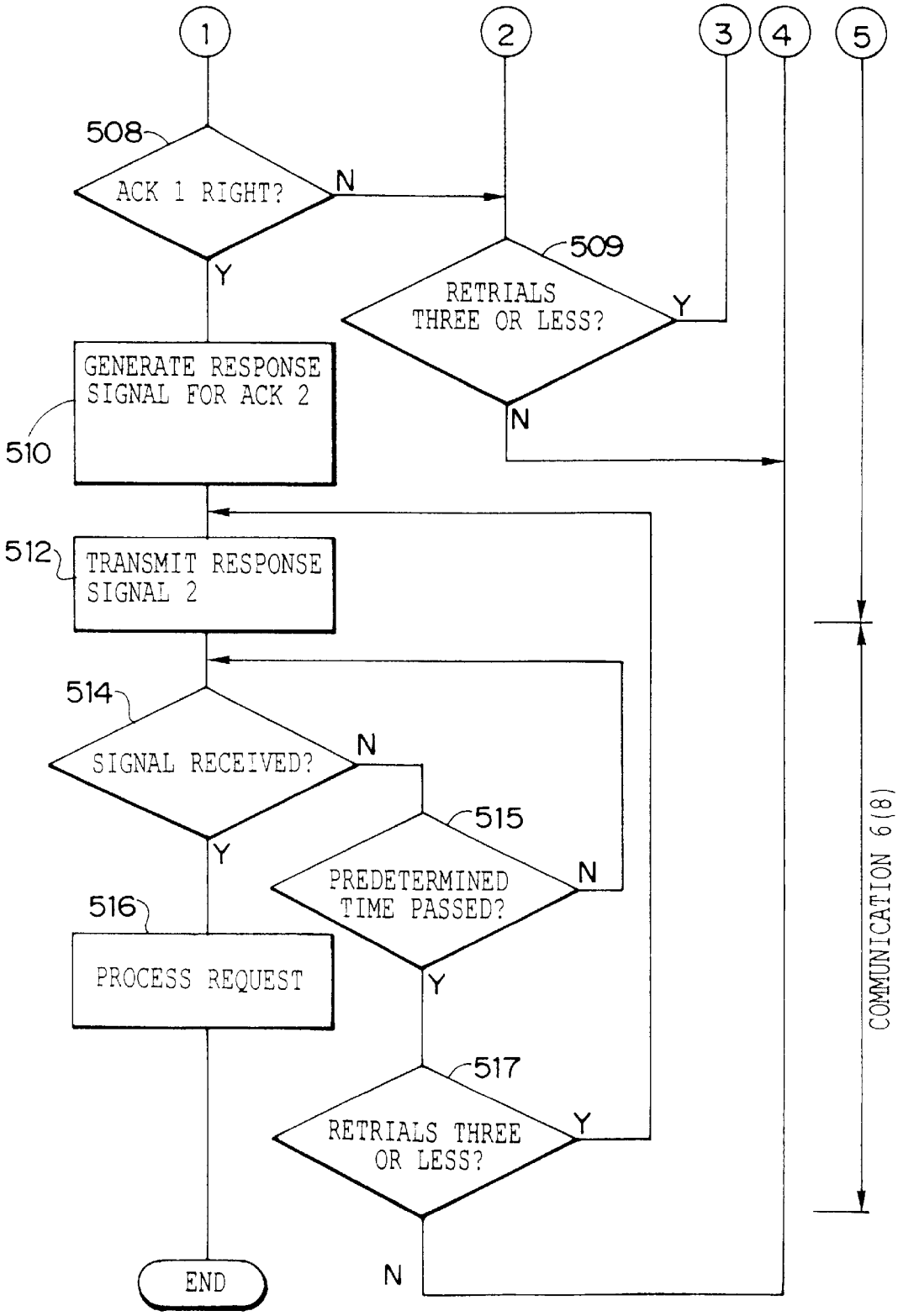

With the vehicle-mounted unit, step 500 decides whether an inquiry signal has been received or not as shown in FIG. 15A. If the decision is affirmative indicating that an inquiry signal has been received, step 502 gives the acknowledgment 1 and generates a response signal 1 with the time of the vehicle-mounted unit stored in the memory circuit 48 added thereto. The next step 504 transmits the response signal 1 (corresponding to the communication 2 for transmitting the processed data Tg1*c* in FIG. 15A).

In the case where the decision at step 500 is negative and the inquiry signal is not received, the process proceeds to step 540. Step 540 decides whether the electric field intensity measured by the electric field intensity measuring circuit 36 has exceeded a predetermined value. In other words, step 540 decides whether the output signal of the comparator 38 is at high level or not to decide whether the vehicle-mounted unit is present in the communication area or not. In the case where the vehicle-mounted unit exists outside the communication area, the process returns to step 500. When the vehicle-mounted unit advances into the communication area, on the other hand, the process proceeds to step 522 thereby to decide whether the current time is set in the memory circuit 48. In the case where the current time is set in the memory circuit 48, it indicates that a vehicle-mounted unit already exists in the communication area. Therefore, step 522 makes an affirmative decision, and the process returns to step 500 directly. In the case where the current time is not set in the memory circuit 48, on the other hand, the process proceeds to step 522, where the current time from the timer 42 is set in the memory circuit 48, after which the process returns to step 500. As a consequence, the current time for the vehicle-mounted unit which has advanced into the communication area of the ground unit is stored in the memory circuit 48.

When the ground unit receives the response signal 1 from the vehicle-mounted unit (when the decision is affirmative in step 402 of FIG. 14), step 420 decides whether a response signal is received from a plurality of vehicle-mounted units. In the case where the decision is negative at step 420, it indicates that the particular vehicle is the only one existing in the communication area. Therefore, step 404 generates a response signal as described above, which signal is transmitted in the next step 406 (corresponding to the communication 3 for transmitting the processed data In2*c* in FIG. 13).

When the ground unit receives a response signal from a plurality of vehicle-mounted units, step 420 makes an affirmative decision, and a vehicle-mounted unit with the current time earlier than any of the other vehicle-mounted units as of the time when a predetermined electric field intensity is exceeded is selected as an object of communication. In the case where there are a plurality of vehicle-mounted units having the same current time, a vehicle-mounted unit is selected according to a predetermined order of priority or by a random number generated in a predetermined manner. Even when a plurality of vehicle-mounted units exist in the communication area and the ground unit receives a response signal from a plurality of vehicle-mounted units, therefore, the choice is a vehicle-mounted unit which has the earlier current time and expected to pass the communication area at the earliest time.

Figure 13:
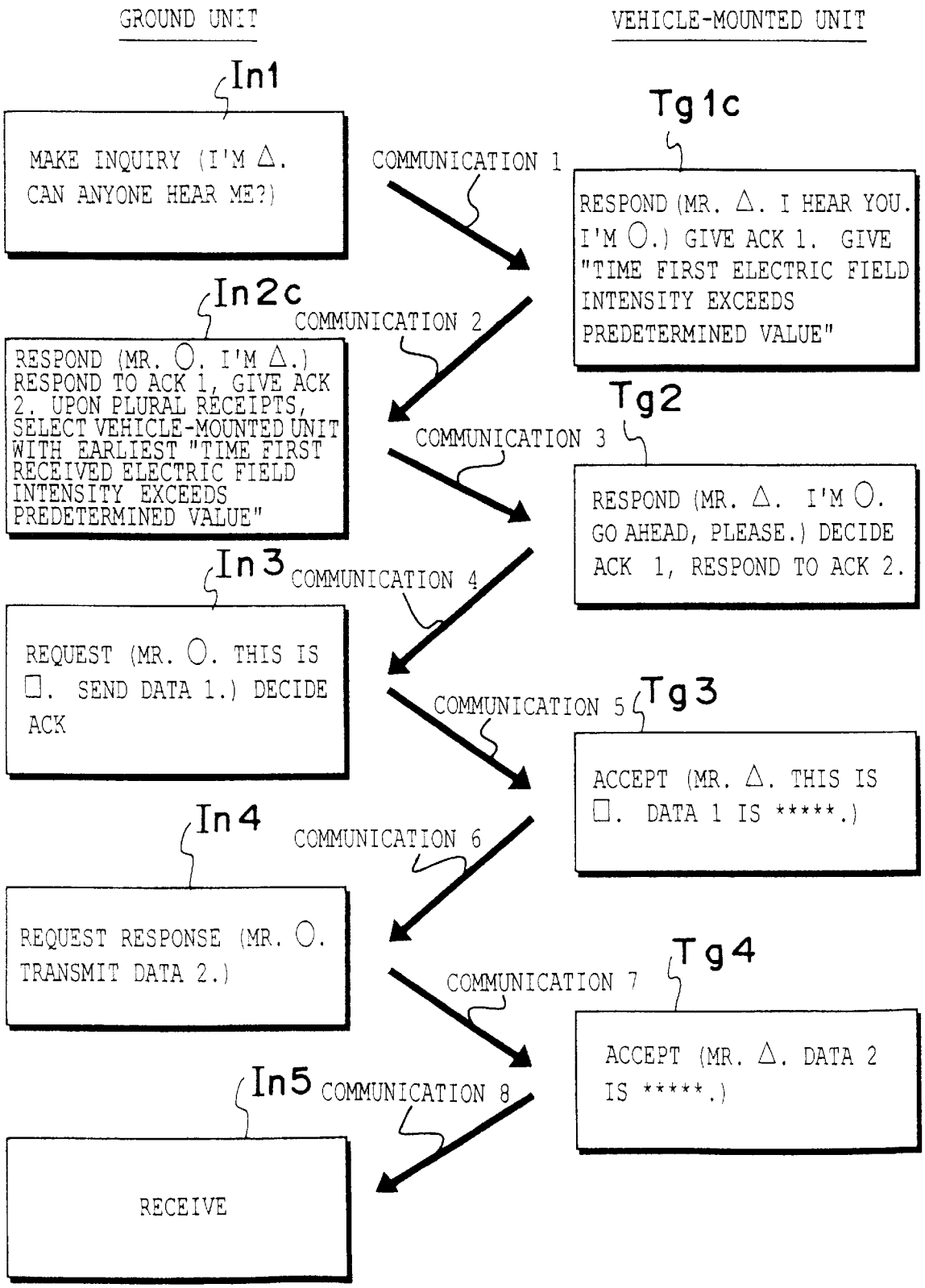
FIG. 13 is a schematic diagram showing the concept of basic signal transmission and receipt (communication) by a handshake conducted between a vehicle-mounted unit and a ground unit according to the third embodiment.
Figure 14:
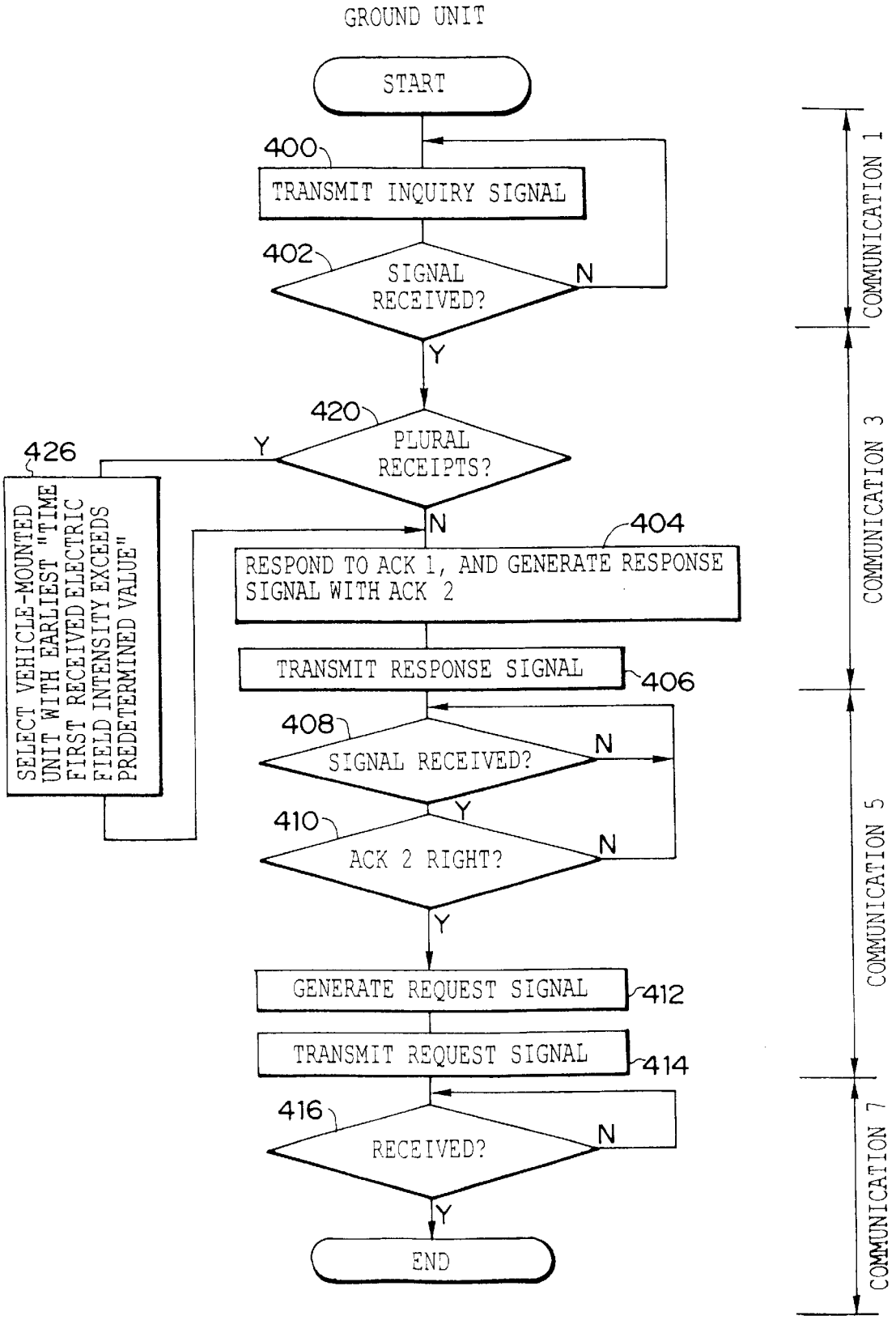
FIG. 14 is a flowchart showing the flow of a processing routine for the ground unit according to the third embodiment.

In the case where step 506 of FIG. 15A makes an affirmative decision as to whether a response signal is received among the processes corresponding to the communication 4 for transmitting the processed data Tg2 in FIG. 13 for the vehicle-mounted unit, and also in the case where the decision of the next step 530 is affirmative as to whether the communication is to the particular vehicle-mounted unit, then the memory circuit 48 is set in step 532 and the process proceeds to step 508.

The steps including and subsequent to step 508 corresponding to the communication 6, 8 for transmitting the processed data Tg3, Tg4 in FIG. 13 are similar to those of FIGS. 7A and 7B, and therefore will not be described. Also, the process including and subsequent to step 408 in FIG. 14 corresponding to the communication 5, 7 for transmitting the processed data In3, 4 of FIG. 13 for the ground unit and the process corresponding to the processed data In5 are similar to those of FIG. 6 and therefore will not be described.

In this way, according to this embodiment, even when a plurality of vehicle-mounted units exist in the communication area of the ground unit and a response signal is received from a plurality of vehicle-mounted units by the ground unit, a vehicle-mounted unit on a vehicle having the earliest current time of advancing into the communication area among those transmitted from a plurality of vehicle-mounted units is selected as an object of communication. It becomes thus possible to communicate with a vehicle-mounted unit having the earliest time to advance into the communication area and expected to pass the communication area at the earliest time.

A vehicle-mounted unit is also assumed to advance into a communication area when the electric field intensity exceeds a predetermined value. The advance into the communication area, therefore, can be detected only by a continuous radio wave transmitted from the ground unit. Also, the radio wave is sent continuously from the ground unit and the electric field intensity thereof is measured. The advance into the communication area of a vehicle-mounted unit can thus be detected real time continuously without a periodic time lag which otherwise might be caused by sampling or the like.

Now, a fourth embodiment will be explained. According to the fourth embodiment, the fact that a vehicle (vehicle-mounted unit) enters a communication area is detected by the electric field intensity, and the fact that a given vehicle-mounted unit passes the communication area at the earliest time is detected by the distance covered by the vehicle. The configuration of the fourth embodiment is similar to that of the above-mentioned embodiments. Therefore, the same component parts as those in the preceding embodiments will be denoted by the same reference numerals respectively, and will not be described below, the explanation being limited only to the component parts not included in the previous embodiments.

Figure 16:
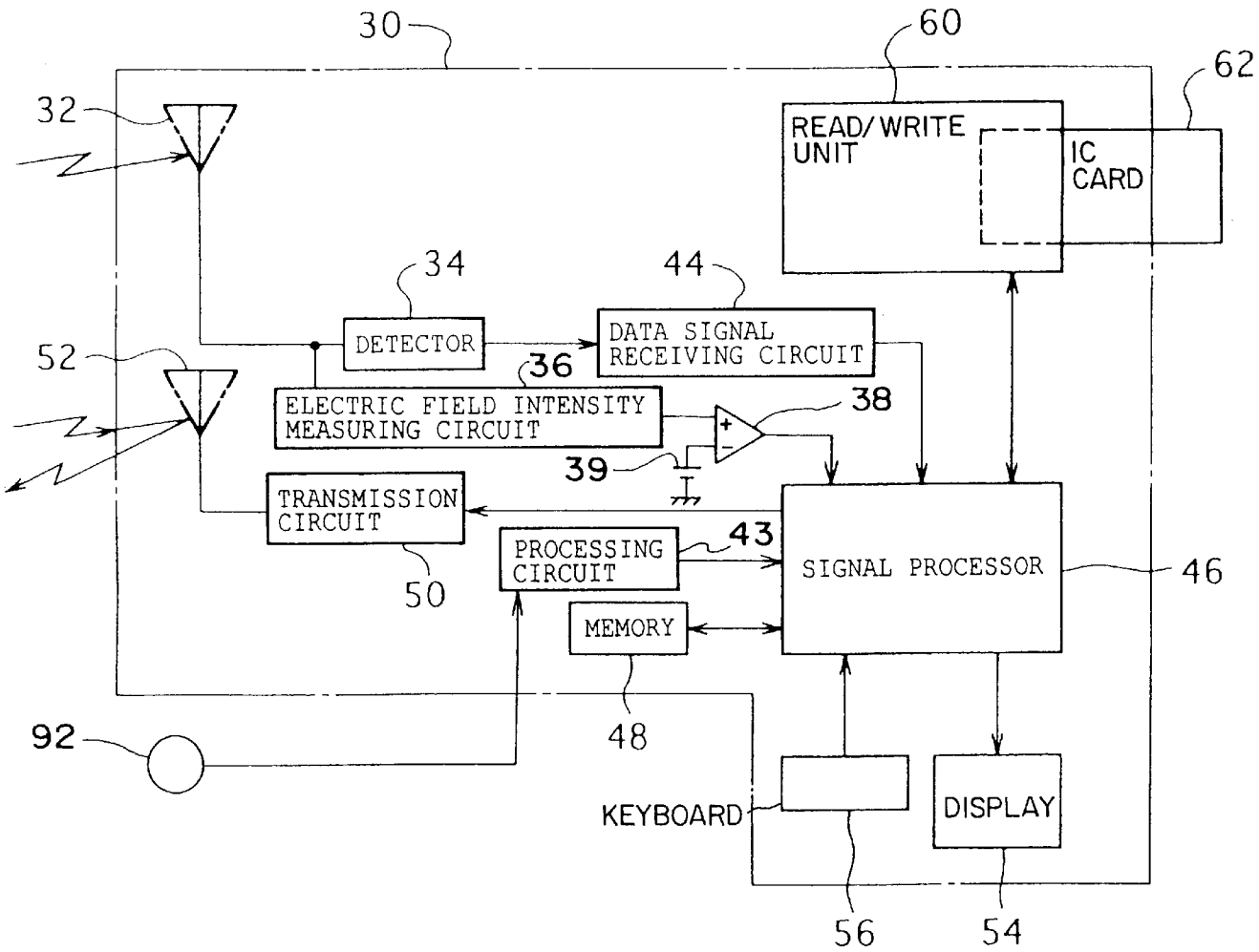
FIG. 16 is a block diagram showing a vehicle-mounted unit according to a fourth embodiment.

First, the configuration of the vehicle-mounted unit 30 mounted on a vehicle according to this embodiment will be explained. As shown in FIG. 16, a receiving antenna 32 of the vehicle-mounted unit 30 is connected to an electric field intensity measuring circuit 36. The electric field intensity measuring circuit 36 is in turn connected to a signal processing circuit 46 through a comparator 38. The comparator 38 has one input terminal thereof connected to the electric field intensity measuring circuit 36 and the other input terminal thereof connected to a power supply 39. Also, the signal processing circuit 46 is connected to a processing circuit 43 which in turn is connected with a distance coverage sensor 92.

Now, the processing operation according to the present embodiment will be explained with reference to FIGS. 17 to 19A and 19B. The ground unit installed in the intermediate route transmits an inquiry signal of continuous radio wave in step 400 until a response signal is received from the vehicle-mounted unit as shown in FIG. 18 (corresponding to the communication 1 for transmitting the processed data In1 of FIG. 17).

When the vehicle-mounted unit receives an inquiry signal (an affirmative decision in step 500 of FIG. 19A), step 534 gives an acknowledgment 1. At the same time, as described later, a response signal 1 is generated with the count value C added corresponding to the coverage stored in the memory circuit 48, which response signal 1 is transmitted in step 504 (corresponding to the communication 2 for transmitting the processed data Tg1*d* of FIG. 19A).

In the case where the decision in step 500 is negative and no inquiry signal is received, on the other hand, step 540 decides whether the electric field intensity measured by the electric field intensity measuring circuit 36 has exceeded a predetermined value or not thereby to decide whether there exists a vehicle-mounted unit in the communication area. In the case where a vehicle-mounted unit is outside of the communication area, the process returns to step 500. In the case where the vehicle-mounted unit advances into the communication area, on the other hand, the process proceeds to step 526 for deciding whether the counter circuit of the processing circuit 43 is operating or not. If the counter circuit is operating, it indicates that a vehicle-mounted unit already exists in the communication area, so that step 526 makes an affirmative decision followed by returning to step 500. In the case where the counter circuit is not in operation, on the other hand, the process is passed to step 528, and after instructing the counter circuit of the processing circuit 43 to start operation, returns to step 500. In this way, the distance covered after the vehicle-mounted unit enters the communication area is measured.

When the ground unit receives the response signal 1 from the vehicle-mounted unit (step 402 in FIG. 18), step 420 decides whether a response signal has been received from a plurality of vehicle-mounted units or not. If the decision in step 420 is negative, it indicates that only the particular vehicle-mounted unit exists in the communication area, and therefore the next step 404 generates a response signal, which is transmitted in step 406 (corresponding to the communication 3 for transmitting the processed data In2*d* in FIG. 17).

When the ground unit receives the response signal from a plurality of vehicle-mounted units, step 420 makes an affirmative decision, followed by step 424 for selecting a vehicle-mounted unit with the longest distance coverage, i.e., with the highest count value as an object of communication. In the case where a plurality of vehicle-mounted units have the same coverage, a vehicle-mounted unit is selected according to a predetermined order of priority or by the random number generated for that purpose. As a result, even when a plurality of vehicle-mounted units exist in the communication area and the ground unit receives a response signal from a plurality of vehicle-mounted units, the vehicle-mounted unit selected is the one with the longest distance covered after advancing into the communication area and expected to pass the communication area at the earliest time.

Figure 17:
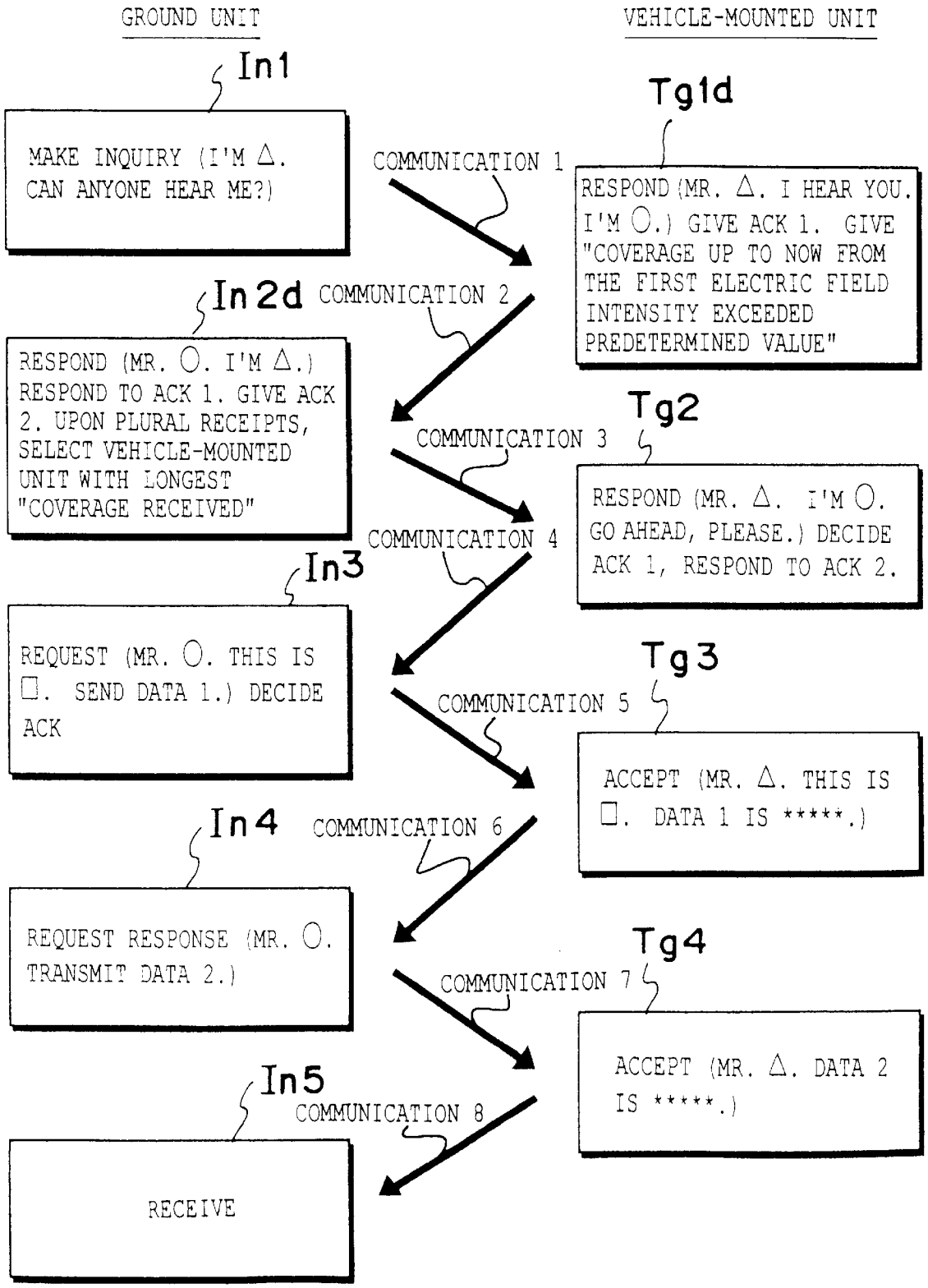
FIG. 17 is a schematic diagram showing the concept of basic signal transmission and receipt (communication) by a handshake conducted between a vehicle-mounted unit and a ground unit according to the fourth embodiment.
Figure 18:
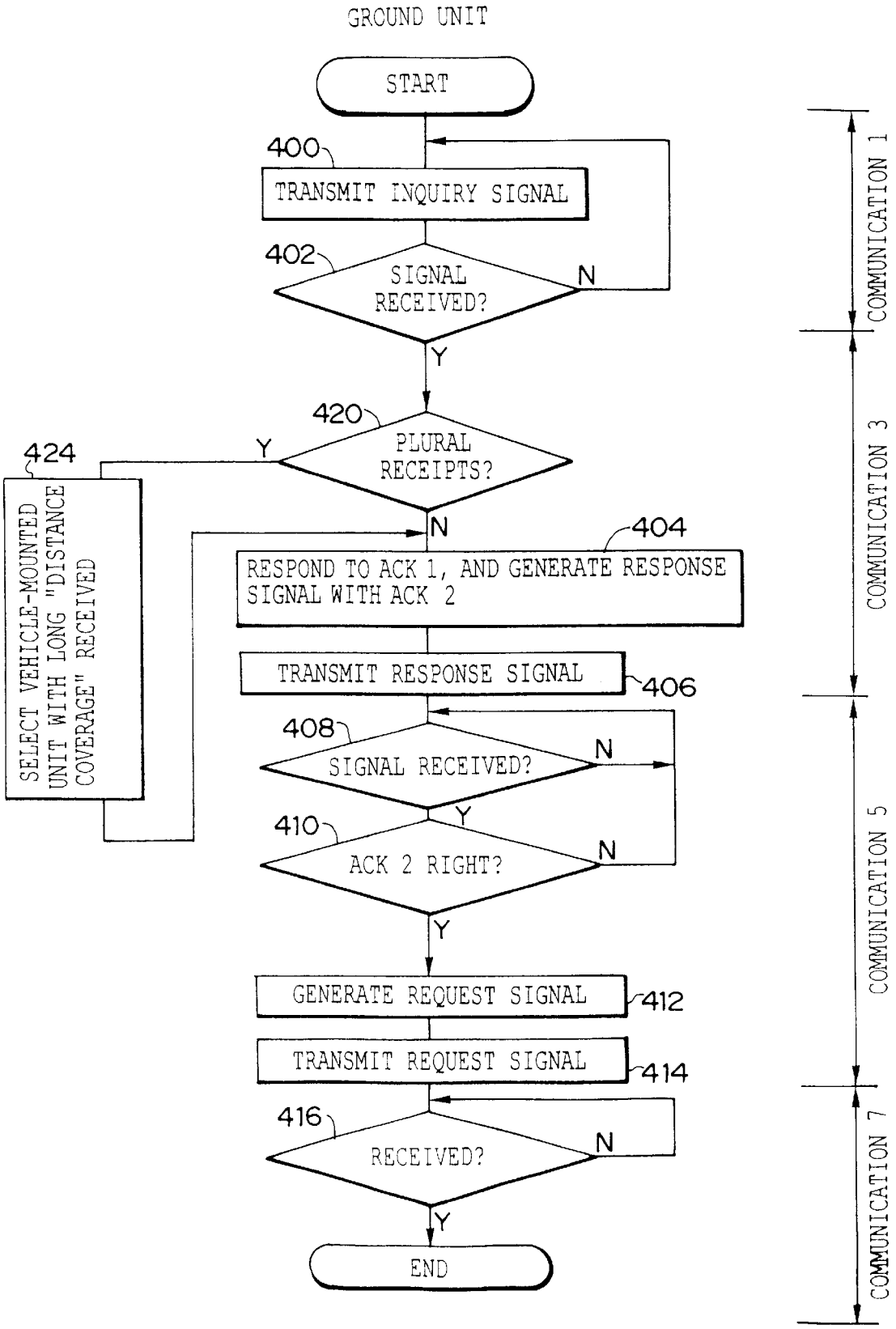
FIG. 18 is a flowchart showing the flow of a processing routine for the ground unit according to the fourth embodiment.
Figure 19A:
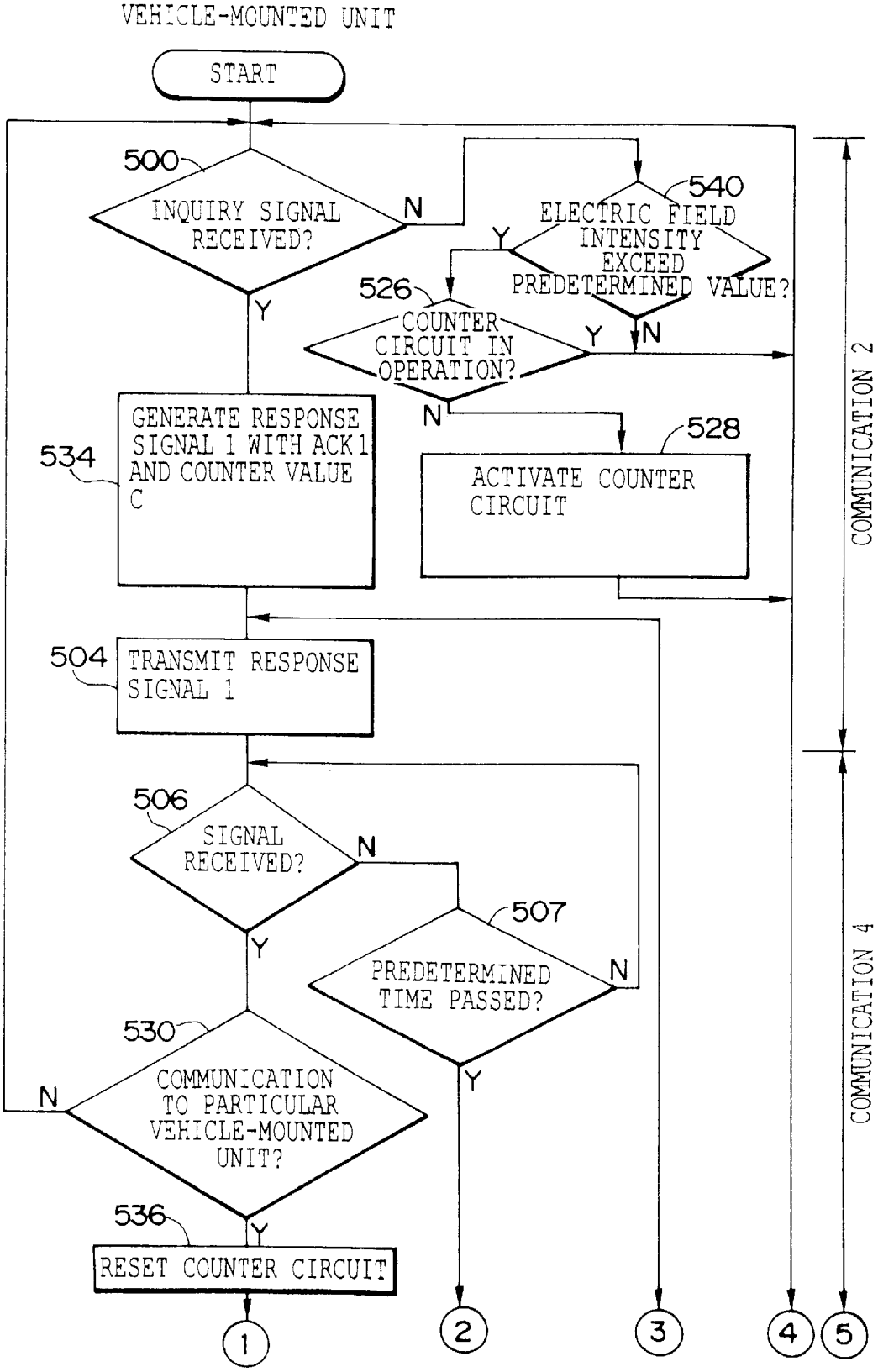
FIGS. 19A and 19B are a flowchart showing the flow of a processing routine for the vehicle-mounted unit according to the fourth embodiment.
Figure 19B:
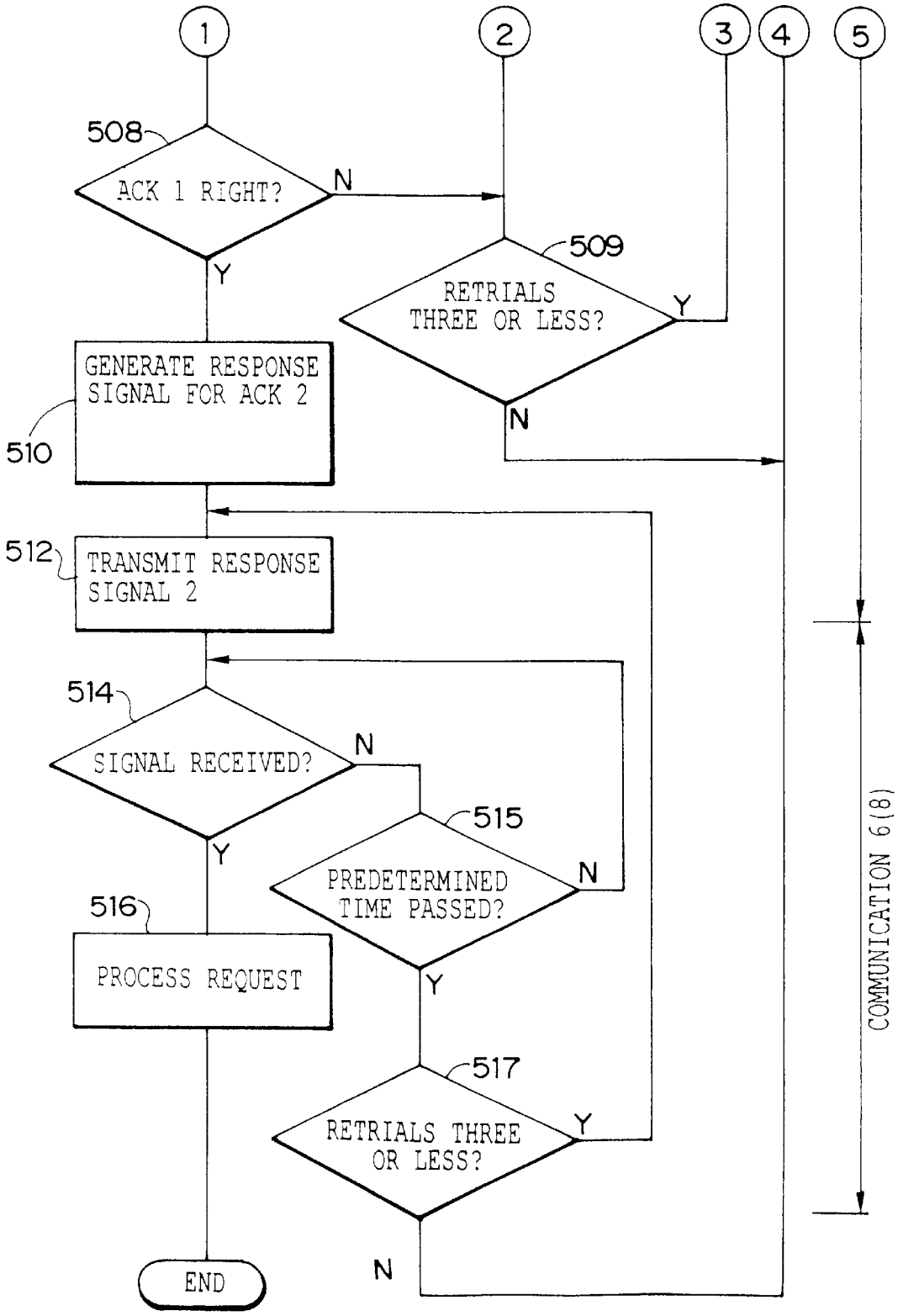

In the process corresponding to the communication 4 for transmitting the processed data Tg2 in FIG. 17 for the vehicle-mounted unit, assume that step 506 in FIG. 19A makes an affirmative decision on the receipt of a response signal and step 530 also makes an affirmative decision as to whether the response signal is the communication addressed to the particular vehicle-mounted unit. Then, step 536 resets the counter circuit of the processing circuit 43 and the process advances to step 508.

The process starting with step 508 corresponding to the communication 6, 8 for transmitting the processed data Tg3, Tg4 in FIG. 17 is similar to that of FIGS. 7A and 7B and therefore will not be described again. Also, the process subsequent to and including step 408 in FIG. 18 corresponding to the processed data In5 and the communication 5, 7 for transmitting the processed data In3, 4 of FIG. 17 for the ground unit is similar to that of FIG. 6 and therefore will not be described any further.

As described above, according to this embodiment, in the case where there are a plurality of vehicle-mounted units in the communication area of the ground unit and the ground unit receives a response signal from a plurality of vehicle-mounted units, then a vehicle-mounted unit with the longest distance coverage after advancing into the communication area among a plurality of vehicle-mounted units is determined as an object of communication. Therefore, communication becomes possible with a vehicle-mounted unit having the longest distance coverage after advancing into the communication area and expected to pass the communication area at the earliest time.

Now, a fifth embodiment will be explained. In the third embodiment described above, the time a vehicle-mounted unit passes the communication area is determined by the current time (the information managed by the vehicle-mounted unit) measured on the vehicle-mounted unit. A failure to calibrate the timer of the vehicle-mounted unit, however, reduces the reliability of temporal accuracy. In the fifth embodiment, the transmission number (information managed by the ground unit) updated for each transmission from the ground unit is returned to select a vehicle-mounted unit with the earliest time to pass the communication area. The fifth embodiment, which is configured the same way as the previous embodiments and has the component parts thereof designated by the same reference numerals as the corresponding parts of the previous embodiments, respectively, will not be described in detail, but only the component parts thereof not included in the previous embodiments will be described.

Figure 20:
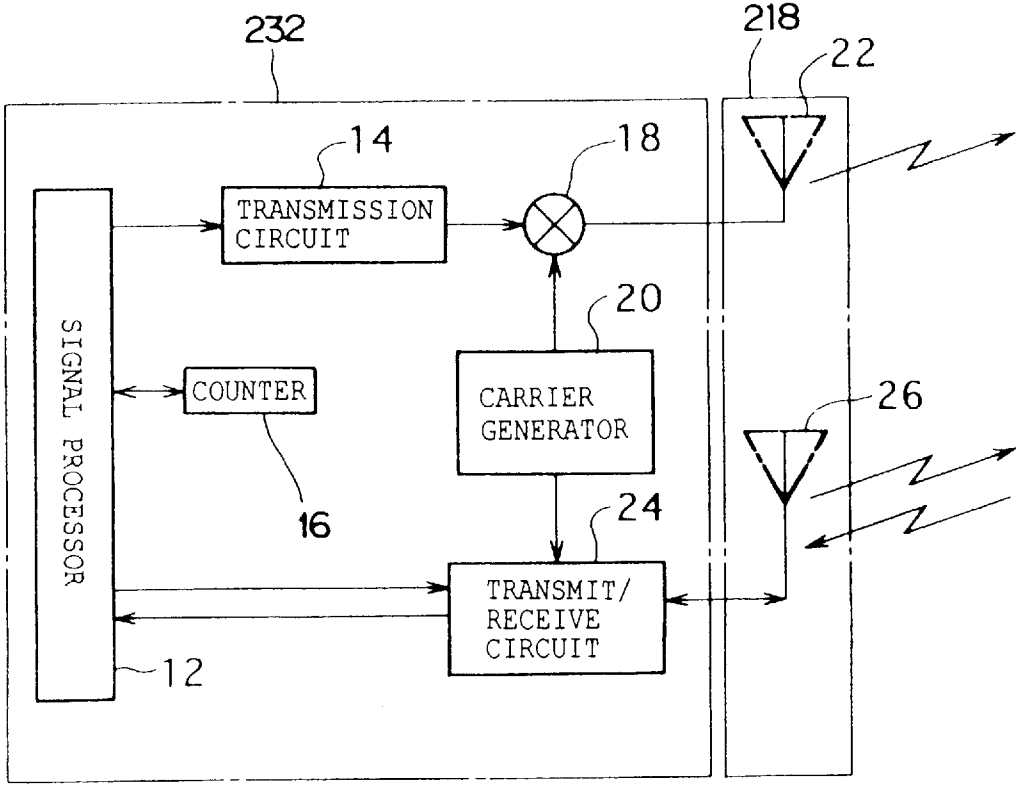
FIG. 20 is a block diagram showing an example of a ground unit according to a fifth embodiment.

First, explanation will be made about the configuration of a route grasping antenna control unit 232 of the ground unit according to this embodiment. As shown in FIG. 20, the route grasping antenna control unit 232 includes a counter 16 connected to a signal processing circuit 12 for counting the transmission number.

Now, the process according to the present embodiment will be described with reference to FIGS. 21 to 23A and 23B.

Figure 21:
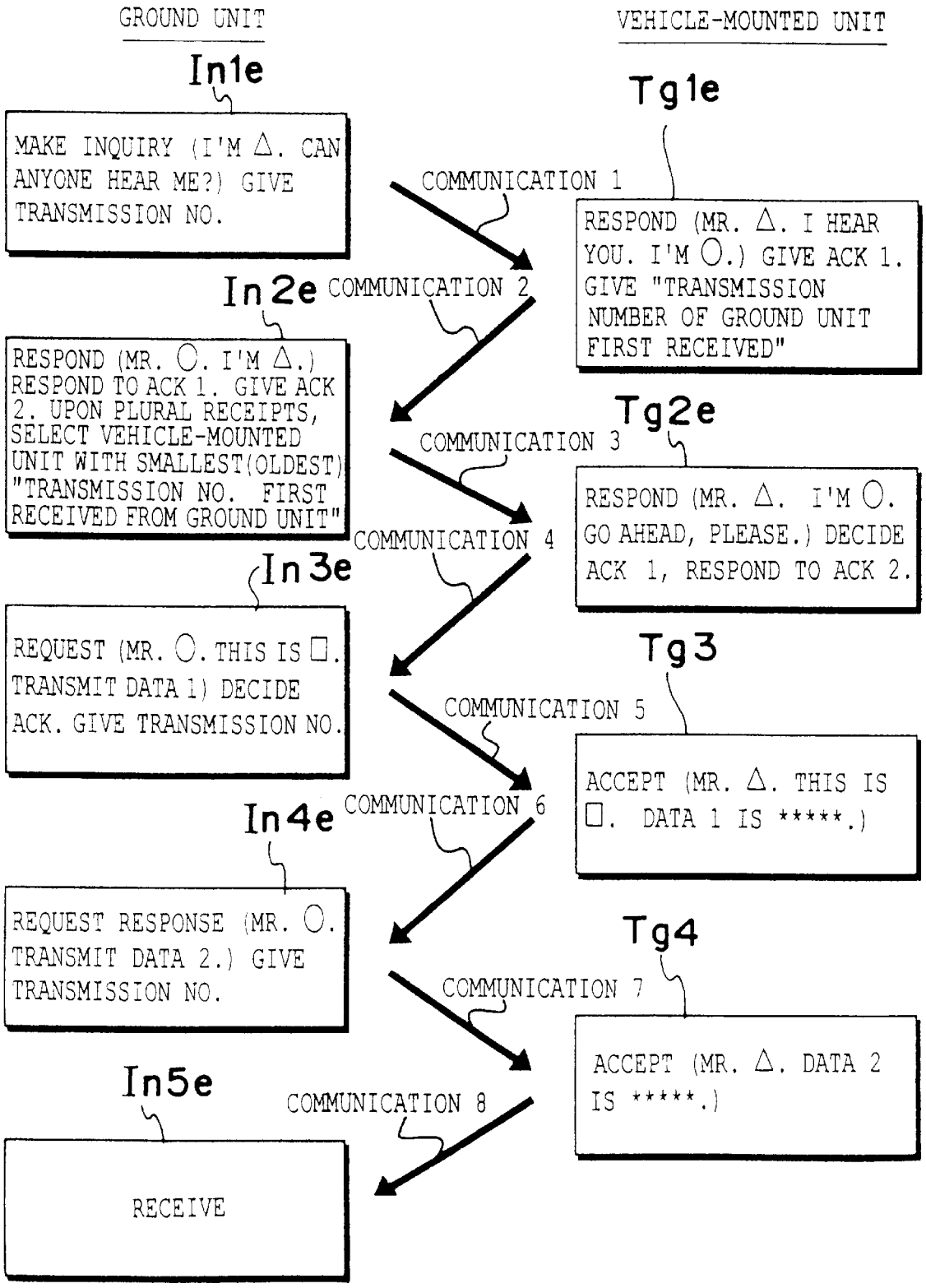
FIG. 21 is a schematic diagram showing the concept of basic signal transmission and receipt (communication) by a handshake conducted between a vehicle-mounted unit and a ground unit according to the fifth embodiment.
Figure 22:
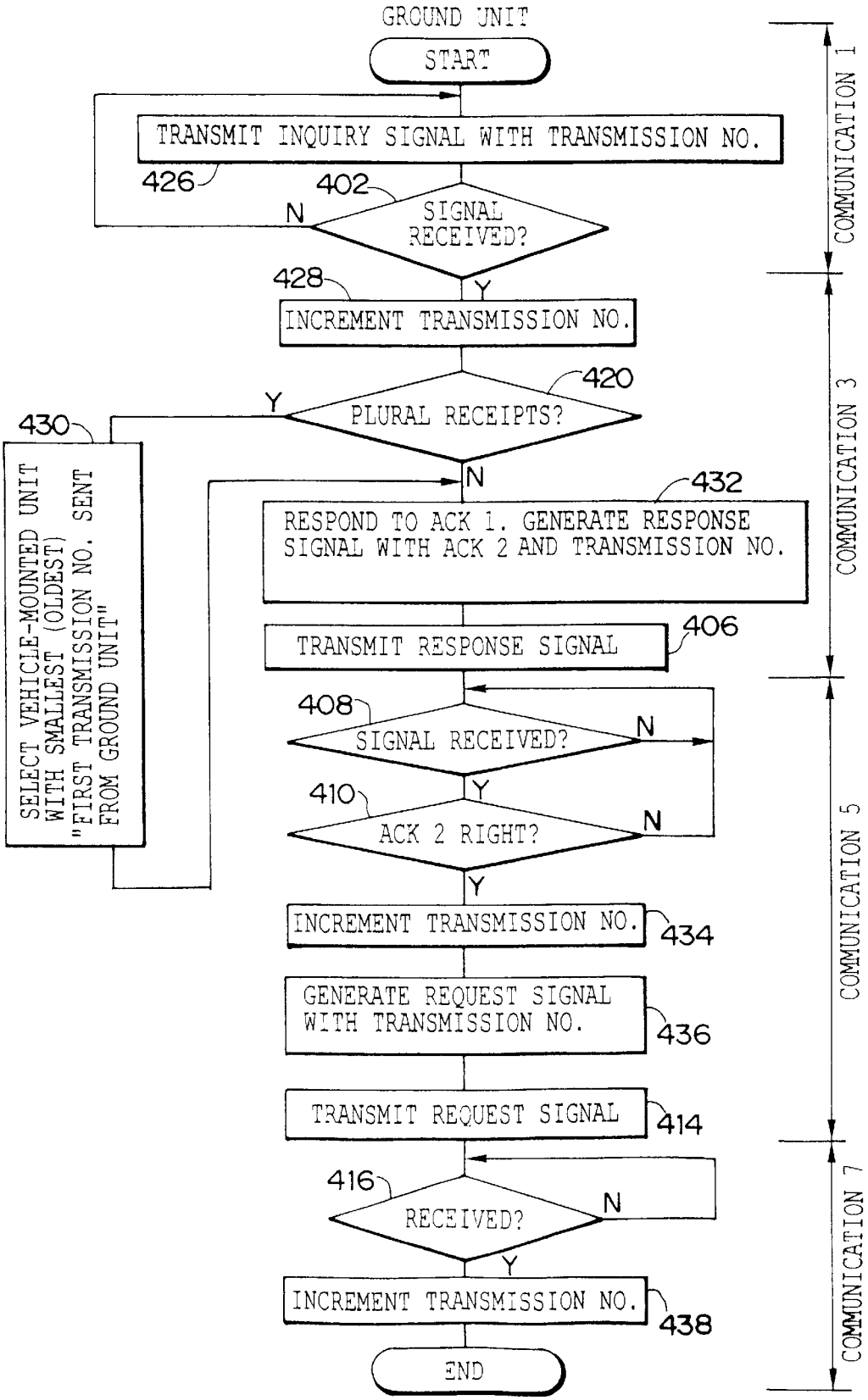
FIG. 22 is a flowchart showing the flow of a processing routine for the ground unit according to the fifth embodiment.

The ground unit installed in the intermediate route transmits an inquiry signal consisting of a continuous wave in step 426 until a response signal is received from the vehicle-mounted unit as shown in FIG. 22 (corresponding to the communication 1 for transmitting the processed data Inle of FIG. 21). In the process, the ground unit transmits the inquiry signal after generating the same signal with the transmission number incremented in accordance with the time stage of the process (each time stage is made up of the series of steps in FIG. 22) and the communication stage (corresponding to the communications 1 to 7).

Upon receipt of an inquiry signal (affirmative decision in step 500 in FIG. 23A), the vehicle-mounted unit gives an acknowledgment 1 in the next step 556, and at the same time generates a response signal L to which the transmission number stored in the memory circuit 48 and transmitted from the ground unit is added as described later, which response signal 1 is transmitted in the next step 504. The process for the vehicle-mounted unit up to this step corresponds to the communication 2 for transmitting the processed data Tg1*e* in FIG. 21.

In the case where step 500 makes a negative decision and no inquiry signal is received, on the other hand, the process proceeds to step 550. Even in the case where step 500 makes a negative decision and no inquiry signal is received, other communication may exist from the ground unit. Step 550, therefore, decides as to whether communication is normally received or not, and if not, the process is returned to step 500. In the case where communication is normally received, on the other hand, it is decided that an inquiry signal is not received but other communication exists, and the process is passed to step 552. Step 552 decides whether the transmission number sent from the ground unit is set in the memory circuit 48. In the case where the transmission number is set in the memory circuit 48, it indicates that a vehicle-mounted unit already exists in the communication area. Therefore, step 552 makes an affirmative decision, followed by returning to step 500. In the case where the transmission number is not set in the memory circuit 48, by contrast, the process proceeds to step 554 for setting the transmission number received from the ground unit in the memory circuit 48, followed by returning to step 500. In this way, the transmission number from the ground unit at the point in time when the vehicle-mounted unit advances into the communication area of the ground unit is stored in the memory circuit 48.

When the ground unit receives a response signal 1 from the vehicle-mounted unit (affirmative decision in step 402 of FIG. 22), step 428 increments the transmission number by one, followed by step 420 for deciding whether the response signal has been received from a plurality of vehicle-mounted units or not. In the case where the decision of step 420 is negative, it indicates that only the particular vehicle-mounted unit exists in the communication area. Step 432 thus generates a response number with the transmission number attached thereto, which is transmitted in step 406 (corresponding to the communication 3 for transmitting the processed data In2*e* of FIG. 21). The response signal generated in step 432 has attached thereto the transmission number incremented by one in step 428. As a consequence, the transmission number sent in step 426 is smaller than that sent in step 432.

When the ground unit receives a response signal from a plurality of vehicle-mounted units, step 420 makes an affirmative decision, followed by step 430 for selecting a vehicle-mounted unit carrying the first small transmission number of all the vehicle-mounted units as an object of communication. In the process, in the case where there are a plurality of vehicle-mounted units having the same transmission number, a vehicle-mounted unit is determined according to a predetermined order of priority or by the random number generated for that specific purpose. Even when a response signal is received by the ground unit from a plurality of vehicle-mounted units existing in the communication area, therefore, communication becomes possible with a vehicle-mounted unit in communication or a vehicle-mounted unit expected to pass the communication area at the earliest time.

When a vehicle-mounted unit receives the response signal (affirmative decision in step 506 of FIG. 23) and the received response signal is for communication to the particular vehicle-mounted unit (affirmative decision in step 530), then step 558 resets the transmission number of the memory circuit 48 and the process proceeds to the next step 508.

Figure 23A:
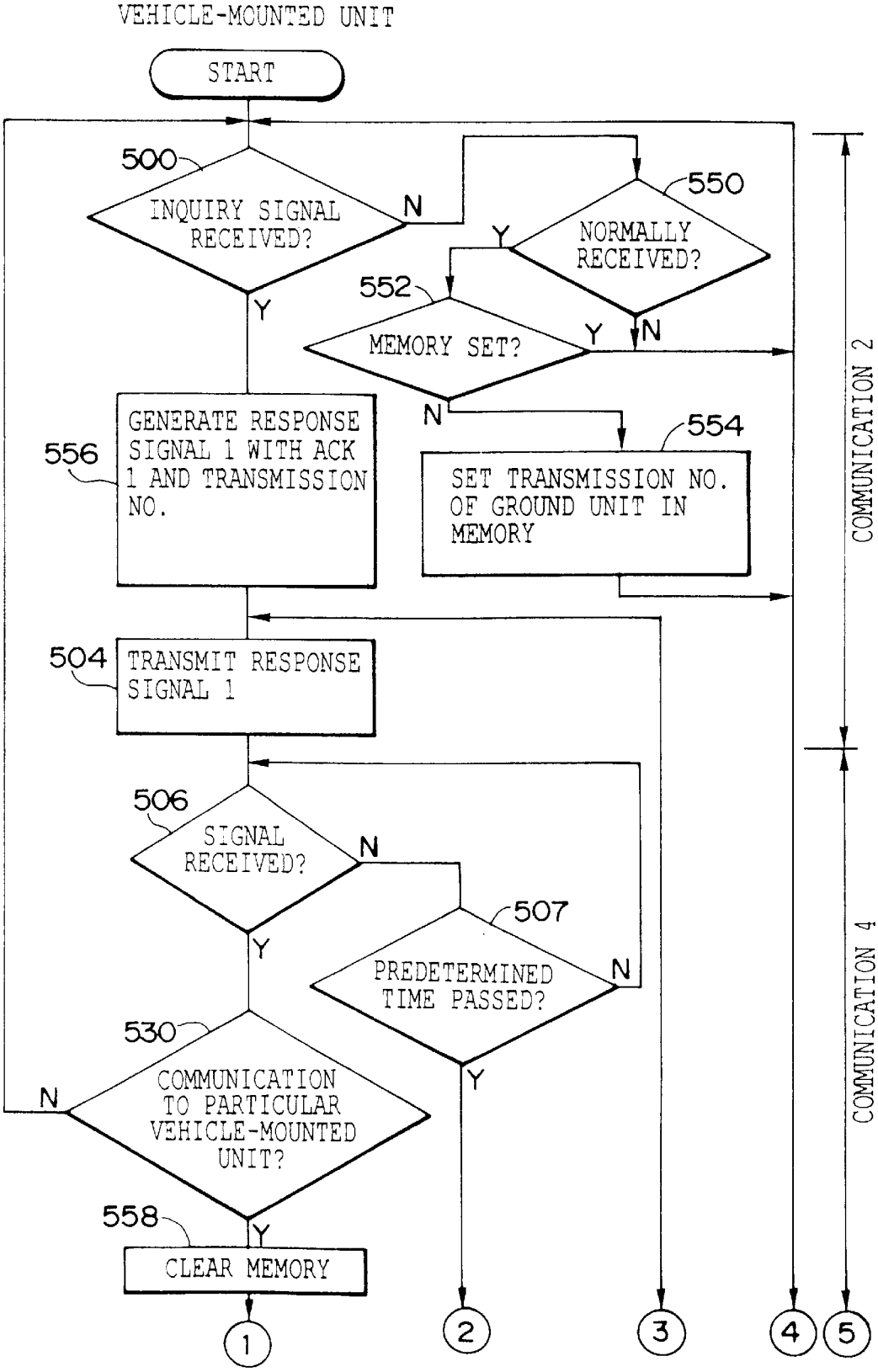
FIGS. 23A and 23B are a flowchart showing the flow of a processing routine for the vehicle-mounted unit according to the fifth embodiment.
Figure 23B:
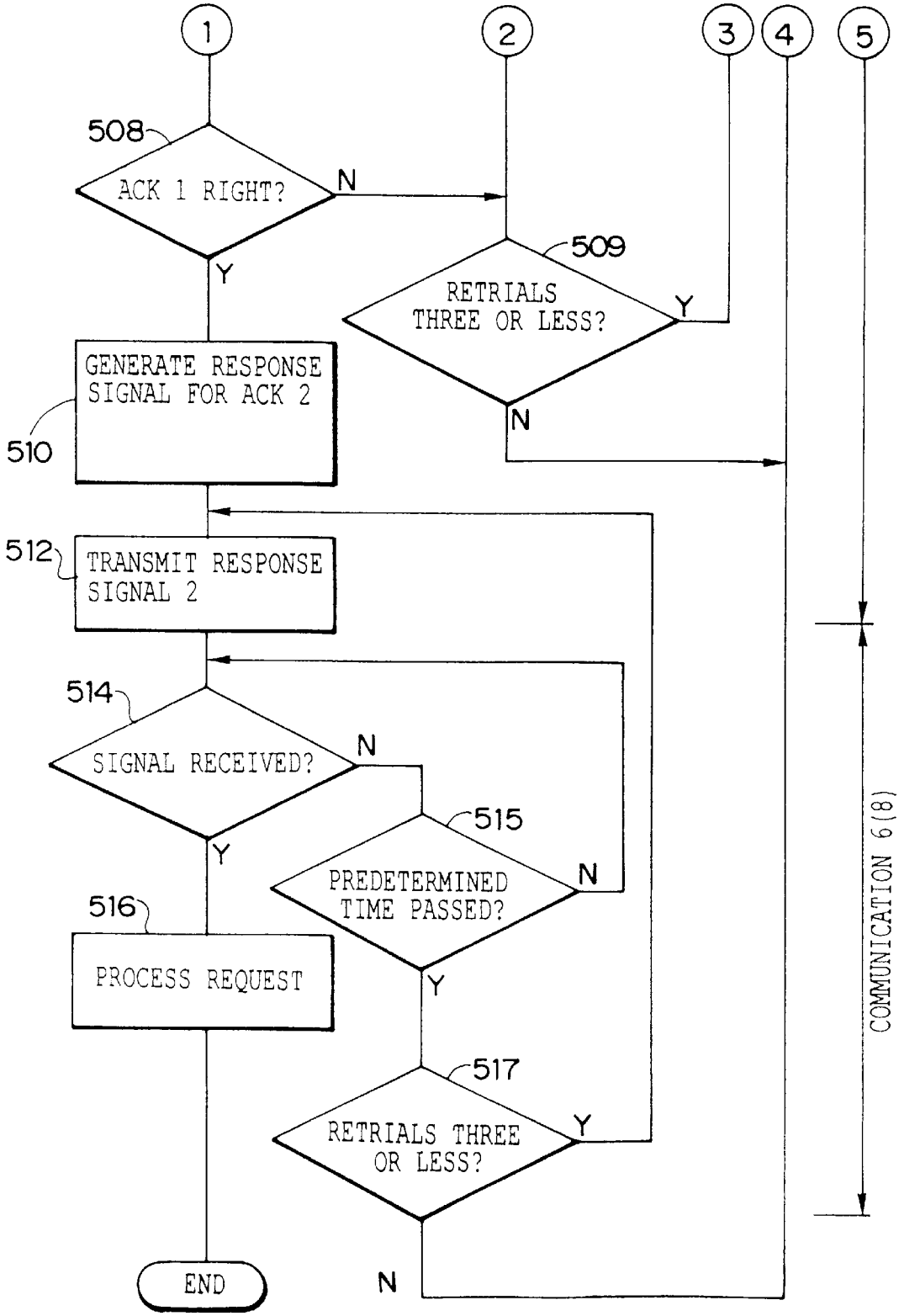

The process including and subsequent to step 508 in FIG. 23B (the process including and subsequent to the communication 4 for transmitting the processed data Tg2*e* of FIG. 21) is the same as the corresponding process in FIG. 6 and will not be explained.

When the ground unit receives a response signal and the acknowledgment 2 is affirmed (affirmative decision in steps 408, 410 of FIG. 22), the handshake is assumed to be established. Step 434 thus increments the transmission number by one, followed by step 436 for generating a request number with the transmission number attached thereto. The request signal is transmitted in step 414 (corresponding to the communication 5, 7 for transmitting the processed data In3*e*, In4*e* of FIG. 21). Then, the ground unit repeatedly executes step 416 until data is received (corresponding to the processed data In5*e* in FIG. 21). Upon complete receipt of the data, the next step 438 increments the transmission number by one, after which the handshake is cancelled thereby to terminate the routine of FIG. 22.

In this way, according to this embodiment, the transmission number sent from the ground unit is managed by the ground unit and incremented in accordance with the stage of communication conducted with the vehicle-mounted unit. Also, the vehicle-mounted unit returns the first-received transmission number as it is. As a result, the ground unit can easily determine the communication timing of the vehicle-mounted units existing in the communication area. Even when a plurality of vehicle-mounted units exist in the communication area of the ground unit and the ground unit receives a response signal from a plurality of vehicle-mounted units, therefore, the communication timing of each vehicle-mounted unit can be determined by detecting the transmission number which is managed by the ground unit and transmitted to each vehicle-mounted unit. The communication thus becomes possible between the ground unit and the vehicle-mounted unit expected to pass the communication area at the earliest time.

In order to process the counter for producing the transmission number in software fashion, the counting operation may be performed by addition and subtraction, for example, and the result may be stored in the RAM of a microcomputer constituting the signal processing circuit. By doing so, the equipment configuration is not required to be changed. It is thus possible to easily realize the invention without changing the conventional device configuration.

Now, a sixth embodiment of the invention will be explained. According to the sixth embodiment, a vehicle-mounted unit expected to pass the communication area at the earliest time is selected by the time a signal is transmitted from the ground unit and returned. The configuration of the sixth embodiment is similar to that of the previous embodiments. Therefore, the same component parts are designated by the same reference numerals as the corresponding parts of the previous embodiments and will not be explained in detail. The explanation that follows refers to only those component parts not included in the previous embodiments.

Figure 24:
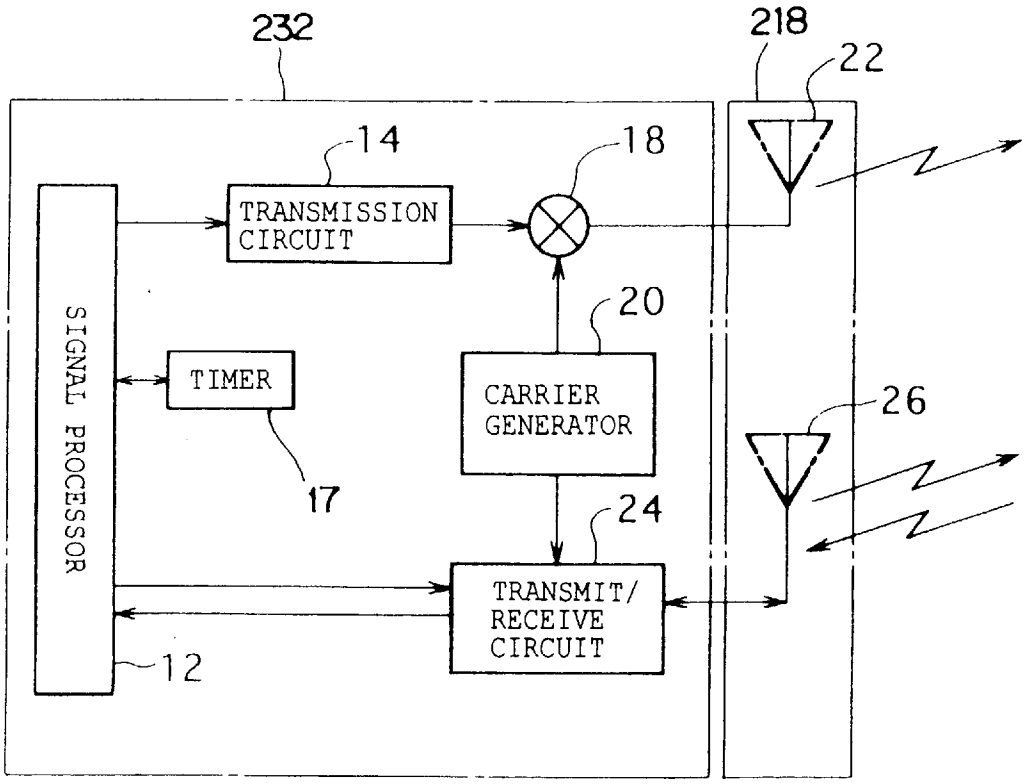
FIG. 24 is a block diagram showing an example of a ground unit according to a sixth embodiment.

First, explanation will be made about the configuration of the route grasping antenna control unit 232 of the ground unit according to this embodiment. As shown in FIG. 24, the route grasping antenna control unit 232 includes a timer 17 for reading the current time. The timer 17 is connected to a signal processing circuit 12. The timer 17 functions as a built-in clock for indicating the current time for the ground unit.

Now, the process according to this embodiment will be explained with reference to FIGS. 25 to 27A and 27B.

Figure 25:
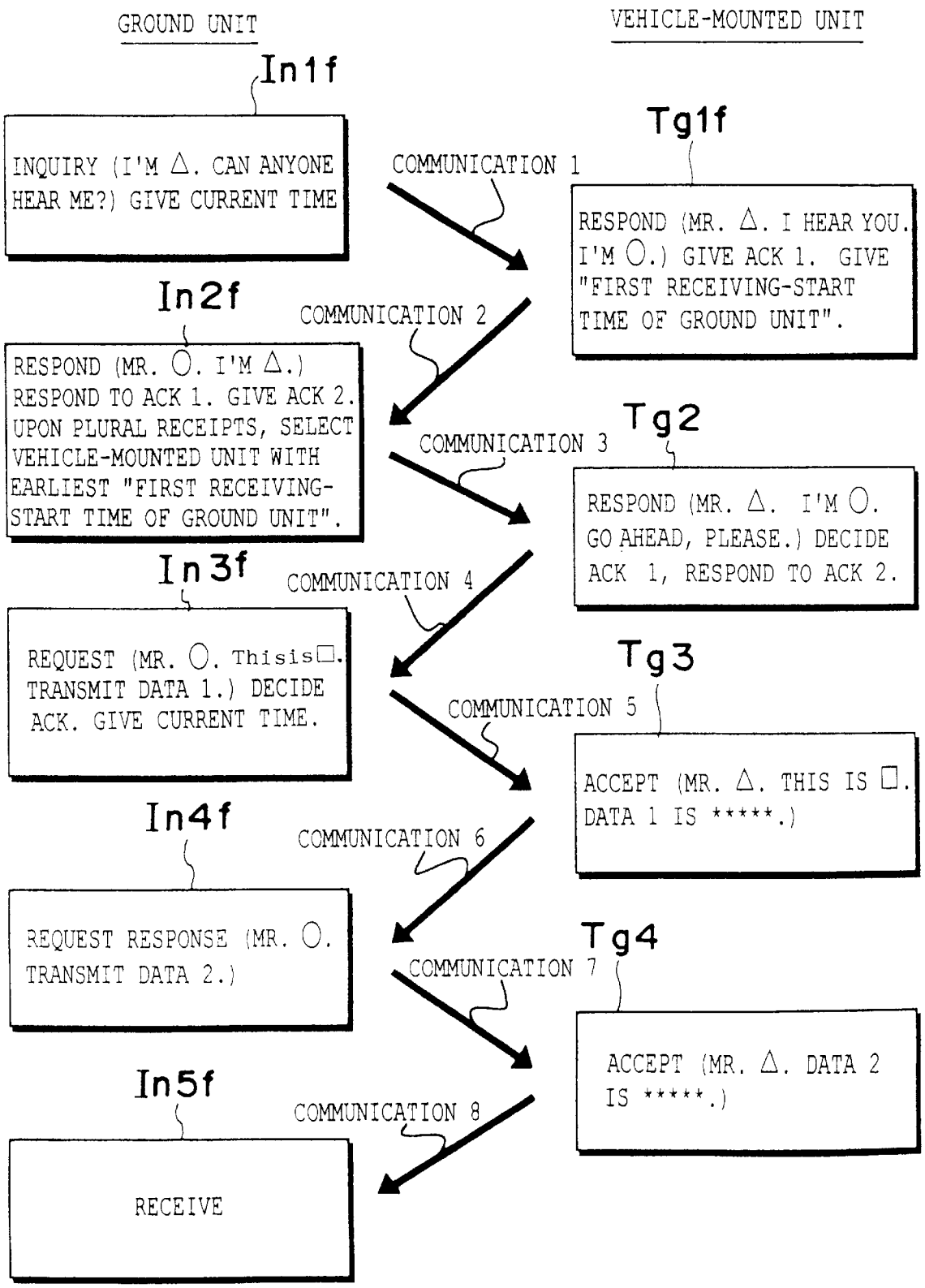
FIG. 25 is a schematic diagram showing the concept of basic signal transmission and receipt (communication) by a handshake conducted between a vehicle-mounted unit and a ground unit according to the sixth embodiment.
Figure 26:
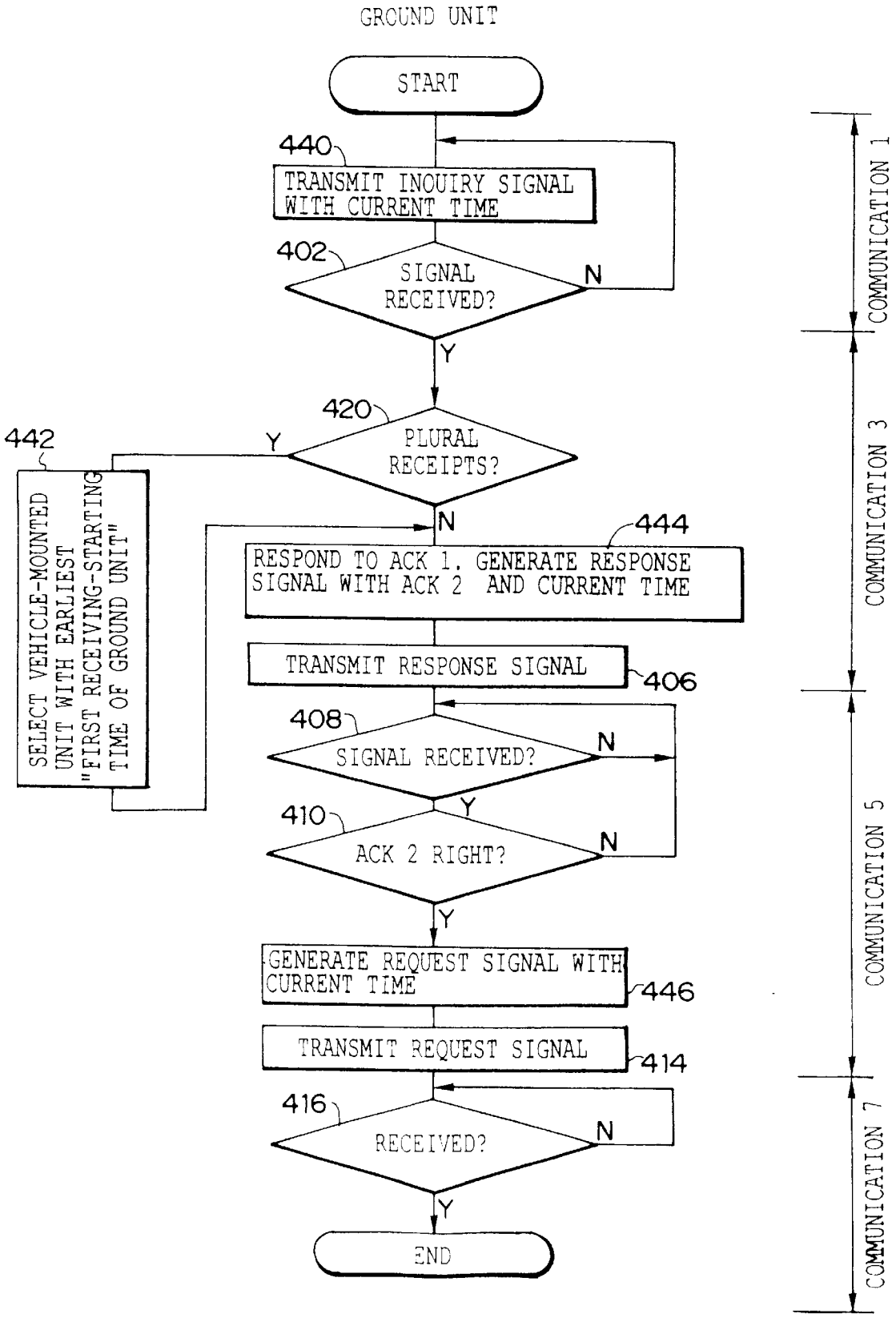
FIG. 26 is a flowchart showing the flow of a processing routine for the ground unit according to the sixth embodiment.
Figure 27A:
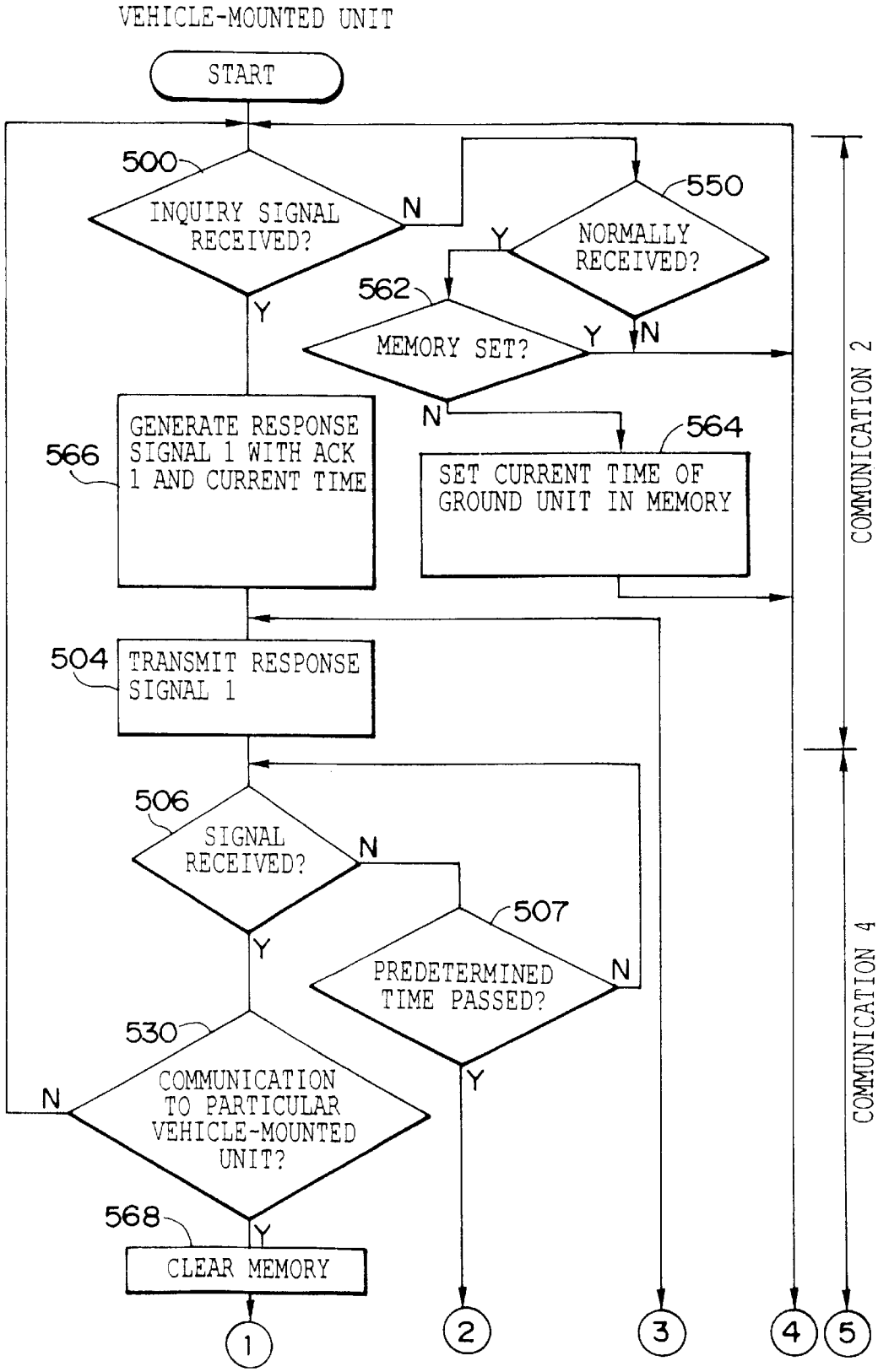
FIGS. 27A and 27B are a flowchart showing the flow of a processing routine for the vehicle-mounted unit according to the sixth embodiment.
Figure 27B:
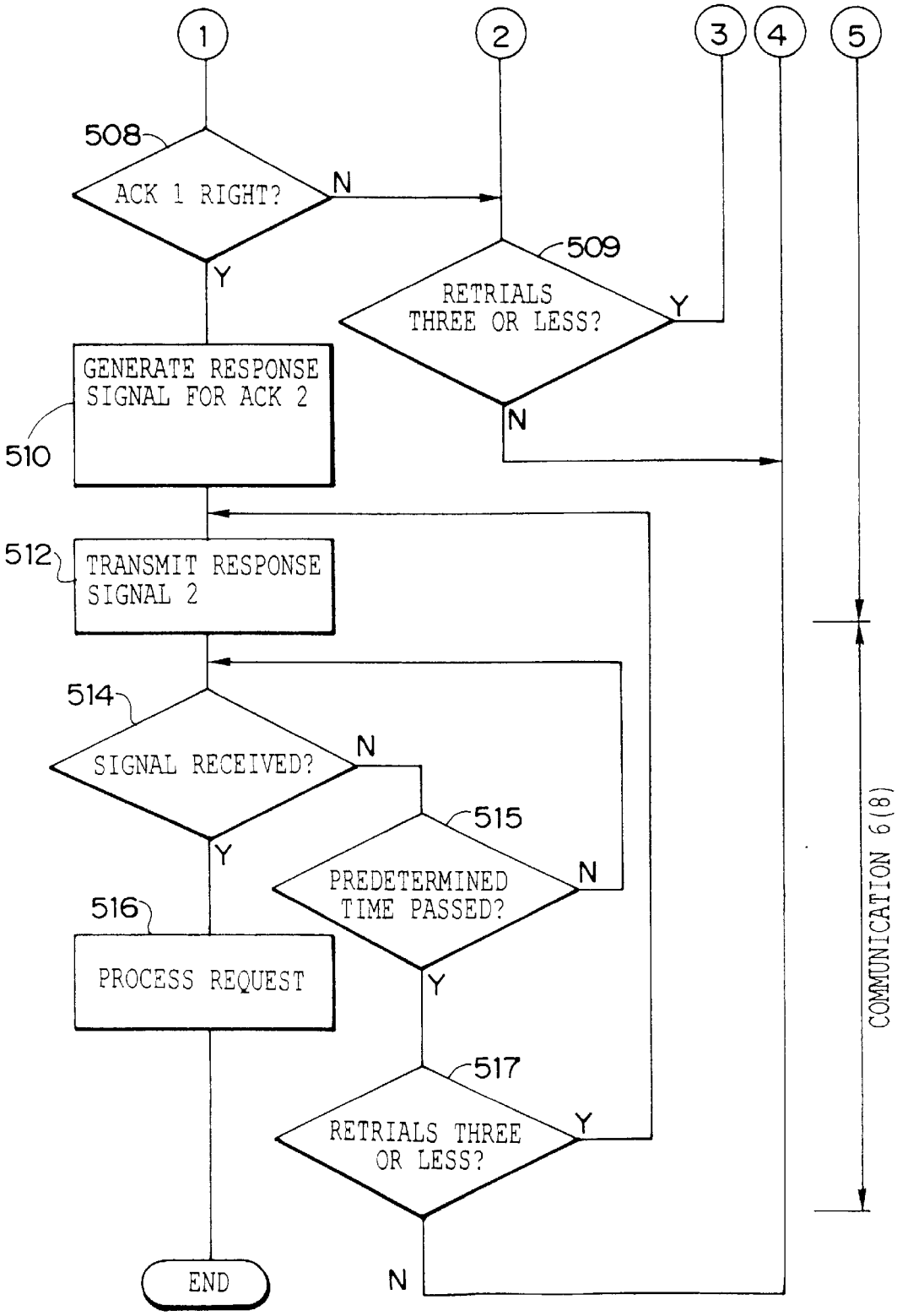

The ground unit installed in the intermediate route transmits an inquiry signal of a continuous wave in step 440 until a response signal is received from the vehicle-mounted unit as shown in FIG. 26 (corresponding to the communication for transmitting the processed data In1f in FIG. 25). The ground unit transmits the inquiry signal only after generating the same inquiry signal with the current time read from the timer 17 and added thereto.

When the vehicle-mounted unit receives the inquiry signal (affirmative decision in step 500 of FIG. 27A), the next step 556 gives an acknowledgment 1, while at the same time generating a response signal 1 having attached thereto the first current time stored in the memory circuit 48 and transmitted from the ground unit as described later, which signal is transmitted in step 504. The process of the vehicle-mounted unit up to the steps mentioned above corresponds to the communication 2 for transmitting the processed data Tg1*f* of FIG. 25.

In the case where the decision in step 500 is negative and no inquiry signal is received, on the other hand, the process proceeds to step 550. Even when no inquiry signal is received, other communication may be undergoing from the ground unit. For this reason, step 550 decides on whether the communication is normally received or not, and if not normal, the process returns to step 500. In the case where communication is normally received, on the other hand, decision is made that other communication may exist although the inquiry signal is not received. The process thus is passed to step 562 for deciding whether the current time sent from the ground unit is set in the memory circuit 48. In the case where the current time is set in the memory circuit 48, it indicates that a vehicle-mounted unit exists already in the communication area, and therefore the process returns to step 500. If the current time is not set in the memory circuit 48, on the other hand, step 564 sets the first current time received from the ground unit in the memory circuit 48, after which the process is returned to step 500. In this way, the current time from the ground unit as of the first advance into the communication area is stored in the memory unit 48.

When the ground unit receives the response signal 1 from the vehicle-mounted unit (affirmative decision in step 402 of FIG. 26), the process proceeds to step 420 for deciding whether a response signal is received from a plurality of vehicle-mounted units or not. In the case where the decision in step 420 is negative, it indicates that the particular vehicle-mounted unit is the sole one existing in the communication area, the next step 444 generates a response signal, which is transmitted in step 406 (corresponding to the communication 3 for transmitting the processed data In2*f* in FIG. 25). The response signal generated in step 444 is accompanied by the current time read by the timer 17.

When the ground unit receives a response signal from a plurality of vehicle-mounted units, step 420 makes an affirmative decision, followed by step 442 for selecting the first vehicle-mounted unit having the earliest current time of the ground unit among all the received current times as an object of communication. In the case where a plurality of vehicle-mounted units have the same current time, a vehicle-mounted unit is selected according to a predetermined order of priority or by the random number generated for this purpose. Consequently, when a plurality of vehicle-mounted units exist in the communication area and the ground unit receives a response signal from a plurality of vehicle-mounted units, then a vehicle-mounted unit in communication or a vehicle-mounted unit expected to pass the communication area at the earliest time is selected as an object of communication.

When a vehicle-mounted unit receives a response signal (affirmative decision in step 506 of FIG. 27A) representing the communication to the particular vehicle-mounted unit (affirmative decision in step 530), then step 568 resets the current time in the memory circuit 48, and the process proceeds to step 508.

The process including and subsequent to step 508 (process including and subsequent to the communication 4 for transmitting the processed data Tg2 in FIG. 25) is similar to the process shown in FIG. 6, and therefore will not be described any further.

When the ground unit receives a response signal and the acknowledgment 2 is right (affirmative decision in steps 408, 410 of FIG. 26), the handshake is considered to have established, and step 446 generates a request signal accompanied by the current time, which signal is transmitted in step 414 (corresponding to the communication 5, 7 for transmitting the processed data In3*f*, In4*f* in FIG. 25). Then, the ground unit repeatedly executes step 416 until data is received (corresponding to the processed data In5f in FIG. 25). Upon complete receipt of the data, the handshake is cancelled, thereby terminating the routine of FIG. 26.

As described above, according to this embodiment, even when there are a plurality of vehicle-mounted units in the communication area and the ground unit receives a response signal from a plurality of vehicle-mounted units, the time of communication with the vehicle-mounted units is determined by detecting the current time transmitted to each vehicle-mounted unit. Communication thus becomes possible with a vehicle-mounted unit expected to pass the communication area at the earliest time.

In each of the above-mentioned embodiments, a plurality of antennas can be set in such a manner that the communication area of an antenna is included in the communication areas of two adjacent antennas. In such a case, even when the communication conditions of the ground unit covered by an antenna becomes faulty, the adverse effect can be accommodated by the communication areas of the remaining antennas.

It will thus be understood from the foregoing description that in the present invention the questioner estimates the time each responder is expected to pass the communication area on the basis of the status information of the communication area transmitted by each responder, and a responder expected to pass the communication area at the earliest time is determined as an object of communication. It is thus possible for the questioner to establish communication with a responder expected to pass the communication area at the earliest time as an object of communication in priority over the remaining responders.

According to another aspect of the present invention, the communication time information representing the time of transmission from the questioner is returned as it is by each responder. The temporal order of the communication with each responder can thus be determined on the basis of the communication time information managed by the questioner. The resulting advantage is that the effect of the variations of vehicle performances including the time measuring function or the distance measuring function of the responders can be reduced and the questioner can be matched with an optimal responder.

While the embodiments of the present invention, as herein disclosed, constitute a referred form, it is to be understood that other forms might be adopted.

What is claimed is:

1. A mobile unit communication control method for exchanging information by radio communication between responders respectively mounted on each of a plurality of mobile units moving on the ground surface and a questioner having a communication area for radio communication with the responders and installed on the ground, said method comprising the steps of:

causing each of said responders to respectively transmit status information representing the status thereof in said communication area; and causing said questioner to estimate the time each of the responders is expected to pass the communication area on the basis of the status information sent from each of said responders and determine the one of said responders estimated to pass the communication area at the earliest time as an object of communication.

2. A mobile unit communication control method according to claim 1, wherein each of said responders determines the status information thereof in said communication area and respectively transmits the status information thus determined.

3. A mobile unit communication control method according to claim 2, wherein said status information from each of the responders is advance time information representing a time each of said responders respectively advanced into said communication area.

4. A mobile unit communication control method according to claim 2, wherein said status information from each of said responders is distance coverage information representing the distance respectively covered by each of said responders after advancing into said communication area.

5. A mobile unit communication control method according to claim 3, wherein the advance of each of said responders into said communication area is respectively detected when a predetermined electric field intensity caused by a radio wave from said questioner is exceeded.

6. A mobile unit communication control method according to claim 4, wherein the advance of each of said responders into said communication area is respectively detected when a predetermined electric field intensity caused by a radio wave from said questioner is exceeded.

7. A mobile unit communication control method according to claim 1, further comprising the steps of:

causing each of said responders to return at least received information as it is; and causing said questioner to transmit communication time information representing a time of communication from said questioner as the status information, estimate the one of said responders which returns the oldest communication time information as the one of said responders expected to pass the communication area at the earliest time on the basis of the communication time information included in the information respectively returned from each of said responders and determine said one of said responders as an object of communication.

8. A mobile unit communication control method according to claim 7, wherein said communication time information is a transmission number updated for each transmission from said questioner.

9. A mobile unit communication control method according to claim 7, wherein said communication time information is a time of transmission from said questioner.

10. A mobile unit communication control method according to claim 1, wherein each of said mobile units is a vehicle moving on a road, each of said responders is a communication unit having an antenna respectively mounted on said vehicle, and said questioner is a communication unit having an antenna installed on the road side.

11. A mobile unit communication control method for exchanging information by radio communication between responders respectively mounted on each of a plurality of mobile units moving on the ground surface and a questioner having a communication area for radio communication with said responders and installed on the ground, said method comprising the steps of:

causing each of said responders to respectively determine the status information representing the status thereof in said communication area and respectively transmit the status information thus determined; and causing said questioner to estimate the time each of the responders is expected to pass the communication area on the basis of said status information sent from each of said responders and determine the one of said responders expected to pass the communication area at the earliest time as an object of communication.

12. A mobile unit communication control method according to claim 11, wherein said status information from each of said responders is advance time information representing a time each of said responders respectively advanced into said communication area.

13. A mobile unit communication control method according to claim 11, wherein said status information from each of said responders is distance coverage information representing the distance respectively covered by each of said responders after respectively advancing into said communication area.

14. A mobile unit communication control method according to claim 12, wherein the advance of each of said responders into said communication area is respectively detected when a predetermined electric field intensity caused by a radio wave from said questioner is exceeded.

15. A mobile unit communication control method according to claim 13, wherein the advance of each of said responders into said communication area is respectively detected when a predetermined electric field intensity caused by a radio wave from said questioner is exceeded.

16. A mobile unit communication control method according to claim 11, wherein each of said mobile units is a vehicle moving on a road, said each of responders is a communication unit having an antenna respectively mounted on said vehicle, and said questioner is a communication unit having an antenna installed on the road side.

17. A mobile unit communication control method for exchanging information by radio communication between responders respectively mounted on each of a plurality of mobile units moving on the ground and a questioner having a communication area for radio communication with said responders and installed on the ground, said method comprising the steps of:

causing each of said responders to respectively return at least received information as it is; and causing said questioner to transmit communication time information representing the time of communication from said questioner, confirm the temporal order of the communication indicated by said communication time information included in the information respectively returned from each of said responders, and determine the one of responders that has returned the oldest communication time information as an object of communication on the basis of the confirmation.

18. A mobile unit communication control method according to claim 17, wherein said communication time information is a transmission number updated for each transmission from said questioner.

19. A mobile unit communication control method according to claim 17, wherein said communication time information is a time of transmission from said questioner.

20. A mobile unit communication control method according to claim 17, wherein each of said mobile units is a vehicle moving on a road, each of said responders is a communication unit having an antenna respectively mounted on said vehicle, and said questioner is a communication unit having an antenna installed on the road side.

* * * * *